US008237051B2

(12) United States Patent
Sexton et al.

(10) Patent No.: US 8,237,051 B2
(45) **Date of Patent: *Aug. 7, 2012**

(54) FLAT WIRE EXTENSION CORDS AND EXTENSION CORD DEVICES

(75) Inventors: Robert Jay Sexton, Hendersonville, TN (US); Fred Lane Martin, Carrollton, GA (US); Charles Alexander Garris, III, Carrollton, GA (US); Stuart Wallace Thorn, Chattanooga, TN (US)

(73) Assignees: Newire, Inc., Knoxville, TN (US); Southwire Company, Carrollton, GA (US)

( * ) Notice: Subject to any disclaimer, the term of this patent is extended or adjusted under 35 U.S.C. 154(b) by 684 days.

This patent is subject to a terminal disclaimer.

(21) Appl. No.: 12/341,056

(22) Filed: Dec. 22, 2008

(65) Prior Publication Data

US 2009/0124113 A1 May 14, 2009

Related U.S. Application Data

(63) Continuation-in-part of application No. 11/932,871, filed on Oct. 31, 2007, now Pat. No. 7,482,535, which is a continuation of application No. 11/688,020, filed on Mar. 19, 2007, now Pat. No. 7,358,437, which is a continuation of application No. 11/437,992, filed on May 19, 2006, now Pat. No. 7,217,884, which is a continuation of application No. 10/790,055, filed on Mar. 2, 2004, now Pat. No. 7,145,073.

(60) Provisional application No. 60/500,350, filed on Sep. 5, 2003.

(51) Int. Cl.
*H01B 11/00* (2006.01)

(52) U.S. Cl. ..... 174/36; 174/110 R; 174/113 R; 174/117 F; 174/117 FF

(58) Field of Classification Search ..... 174/36, 174/110 R, 113 R, 117 R, 117 F, 117 FF, 174/32

See application file for complete search history.

(56) References Cited

U.S. PATENT DOCUMENTS 2,200,776 A 5/1940 Hoover (Continued)

FOREIGN PATENT DOCUMENTS

EP 0569197 A2 4/1993

(Continued)

OTHER PUBLICATIONS

Disclosure Statement Under 37 C.F.R § 1.56 for U.S. Appl. No. 12/341,056, filed Feb. 9, 2009.

(Continued)

*Primary Examiner* — William Mayo, III

(74) *Attorney, Agent, or Firm* — Sutherland Asbill & Brennan LLP

(57) ABSTRACT

A flat wire extension cord includes an elongated cord, a first connected attached to a first end of the elongated cord, and a second connected attached to an opposite end of the elongated cord. The elongated cord includes at least one electrifiable conductor for delivering electrical power, first and second insulating layers formed on opposing sides of the at least one electrifiable conductor, and first and second return conductors formed on the first and second insulating layers, respectively, such that said at least one electrifiable conductor is at least substantially entrapped by said first and second return conductors. The first connector is operable to connect the conductors of the elongated cord to a line side input, and the second connector is operable to connect the conductors of the elongated cord to a load.

24 Claims, 11 Drawing Sheets

U.S. PATENT DOCUMENTS

| | | | | | |
|---|---|---|---|---|---|
| 3,079,458 | A | | 2/1963 | Hedstrom | |
| 3,168,617 | A | | 2/1965 | Richter | |
| 3,547,718 | A | * | 12/1970 | Herman | 156/55 |
| 3,960,622 | A | | 6/1976 | Hofling et al. | |
| 4,185,887 | A | | 1/1980 | Ferrentino | |
| 4,219,928 | A | * | 9/1980 | Kuo | 29/868 |
| 4,355,865 | A | | 10/1982 | Conrad et al. | |
| 4,401,361 | A | | 8/1983 | Slaughter | |
| 4,404,425 | A | | 9/1983 | Rich | |
| 4,407,065 | A | | 10/1983 | Gray | |
| 4,419,538 | A | | 12/1983 | Hansell, III | |
| 4,425,397 | A | | 1/1984 | George | |
| 4,441,088 | A | | 4/1984 | Anderson | |
| 4,616,102 | A | * | 10/1986 | Noorily | 174/36 |
| 4,634,805 | A | | 1/1987 | Orban | |
| 4,644,099 | A | | 2/1987 | Basconi | |
| 4,658,090 | A | * | 4/1987 | Coon | 174/119 R |
| 4,668,581 | A | | 5/1987 | Luc et al. | |
| 4,675,625 | A | | 6/1987 | Johnston | |
| 4,678,864 | A | | 7/1987 | Cox | |
| 4,680,423 | A | | 7/1987 | Bennett et al. | |
| 4,695,679 | A | | 9/1987 | Strauss et al. | |
| 4,698,457 | A | | 10/1987 | Bordbar | |
| 4,746,769 | A | | 5/1988 | Piper | |
| 4,762,965 | A | | 8/1988 | Hata et al. | |
| 4,769,276 | A | | 9/1988 | Gruss et al. | |
| 4,783,579 | A | | 11/1988 | Brandolf et al. | |
| 4,845,311 | A | * | 7/1989 | Schreiber et al. | 174/36 |
| 4,864,081 | A | | 9/1989 | Bates | |
| 4,888,071 | A | | 12/1989 | Kauffman et al. | |
| 4,954,100 | A | | 9/1990 | McCleerey | |
| 4,992,059 | A | | 2/1991 | King et al. | |
| 5,003,273 | A | * | 3/1991 | Oppenberg | 333/1 |
| 5,064,684 | A | | 11/1991 | Mir et al. | |
| 5,068,632 | A | * | 11/1991 | Champeau | 333/238 |
| 5,089,329 | A | | 2/1992 | de Vrieze et al. | |
| 5,136,123 | A | * | 8/1992 | Kobayashi et al. | 174/258 |
| 5,162,611 | A | | 11/1992 | Nichols, III et al. | |
| 5,221,417 | A | | 6/1993 | Basavanhally | |
| 5,250,127 | A | | 10/1993 | Hara | |
| 5,274,195 | A | | 12/1993 | Murphy | |
| 5,274,196 | A | | 12/1993 | Weinberg | |
| 5,274,246 | A | | 12/1993 | Hopkins et al. | |
| 5,281,765 | A | | 1/1994 | Lura et al. | |
| 5,342,997 | A | | 8/1994 | Kanno et al. | |
| 5,373,109 | A | | 12/1994 | Argyrakis et al. | |
| 5,408,053 | A | | 4/1995 | Young | |
| 5,430,247 | A | | 7/1995 | Bockelman | |
| 5,468,159 | A | | 11/1995 | Brodsky et al. | |
| 5,554,825 | A | * | 9/1996 | Parker et al. | 174/117 F |
| 5,847,324 | A | * | 12/1998 | Farquhar et al. | 174/117 FF |
| 6,218,622 | B1 | * | 4/2001 | Rimmer | 174/117 FF |
| 6,276,502 | B1 | | 8/2001 | Leyba et al. | |
| 6,320,133 | B1 | * | 11/2001 | Rimmer | 174/117 F |
| 6,439,360 | B1 | * | 8/2002 | Miller | 191/12.2 R |
| 6,452,772 | B1 | * | 9/2002 | Snyder | 361/93.9 |
| 6,492,595 | B2 | * | 12/2002 | Sexton | 174/117 F |
| 6,841,735 | B1 | * | 1/2005 | Schilson et al. | 174/117 F |
| 2003/0000788 | A1 | * | 1/2003 | Skowronski | 191/12.2 R |

FOREIGN PATENT DOCUMENTS

| | | |
|---|---|---|
| EP | 0569197 A3 | 10/1993 |

OTHER PUBLICATIONS

European Search Report mailed Feb. 23, 2009.

ZIP-LINQ PC Power Cord, Retractable, 115 AC, available through the following link: http://sewelldirect.com/Zip-Linq-PC-Power-Cord-Retractable-115V-AC-5-ft.asp (last accessed on Oct. 7, 2009). p. 1 of 1.

* cited by examiner

FLAT WIRE EXTENSION CORDS AND EXTENSION CORD DEVICES

CROSS REFERENCE TO RELATED APPLICATIONS

The present application is a continuation-in-part of U.S. application Ser. No. 11/932,871, filed Oct. 31, 2007, entitled "Electrical Wiring Safety Device for Use with Electrical Wire" (now U.S. Pat. No. 7,482,535), which is a continuation of U.S. application Ser. No. 11/688,020, filed Mar. 19, 2007, entitled "Electrical Wire and Method of Fabricating the Electrical Wire" (now U.S. Pat. No. 7,358,437), which is a continuation of U.S. application Ser. No. 11/437,992, fled May 19, 2006, entitled "Electrical Wire and Method of Fabricating the Electrical Wire" (now U.S. Pat. No. 7,217,884), which is a continuation of U.S. application Ser. No. 10/790,055, filed Mar. 2, 2004, entitled "Electrical Wire and Method of Fabricating the Electrical Wire" (now U.S. Pat. No. 7,145,073), which claims benefit of U.S. Provisional Application No. 60/500,350, filed Sep. 5, 2003. The disclosures of each of these applications are incorporated by reference herein in their entirety.

TECHNICAL FIELD

This invention generally relates to electrical extension cords and methods of fabricating the extension cords, and more particularly, to flat wire electrical extension cords and extension cord devices.

BACKGROUND OF THE INVENTION

Extension cords are utilized in a wide variety of different applications to provide electrical power to loads situated remotely from an electrical power source, such as an electrical outlet. In a typical application, a conventional extension cord is connected on one end to an electrical outlet and on the other end to an electrical load, such as, an appliance or power tool.

A cross-section diagram of a conventional extension cord 100 is illustrated in FIG. 1. With reference to FIG. 1, a conventional extension cord 100 typically includes an electrifiable conductor 105 (or hot conductor), a return conductor 110 (or neutral or grounding conductor), and a ground conductor 115 (or grounded conductor). The electrifiable conductor 105 and return conductor 110 are typically individually insulated with respective electrifiable conductor insulating material 120 and return conductor insulating material 125. Additionally, an insulation material 130 that surrounds the three conductors 105, 110, 115, such as thermoplastic insulation, is typically provided for the extension cord 100.

As shown in FIG. 1, conventional extension cords often have a rounded shape which contributes to the cords being bully and loose. As a result, conventional extension cords may present a tripping hazard that may be dangerous for individuals near the extension cords.

Additionally, as shown in FIG. 1, the structure of a conventional extension cord may present an electrocution hazard if the extension cord is penetrated by an object, such as a nail or a saw blade, that contacts the electrifiable or hot conductor of the extension cord. If an object, such as a metal object, penetrates the insulation of the extension cord and contacts the electrifiable conductor, an electrocution hazard may, be present. This electrocution hazard may persist until a safety device (if available and utilized), such as a surge protector, is tripped.

Accordingly, there is a need for electrical extension cords and methods for fabricating the extension cords. Additionally, there is a need for flat wire electrical extension cords. There is also a need for electrical extension cords with improved safety characteristics.

BRIEF DESCRIPTION OF THE INVENTION

Some or all of the above needs and/or problems may be addressed by embodiments of the invention. Embodiments of the invention may include flat wire extension cords and extension cord devices. A flat wire extension cord may be provided in one embodiment of the invention, and the flat wire extension cord may include an elongated cord, a first connected attached to a first end of the elongated cord, and a second connected attached to an opposite end of the elongated cord. The elongated cord may include at least one electrifiable conductor for delivering electrical power, first and second insulating layers formed on opposing sides of the at least one electrifiable conductor, and first and second return conductors formed on the first and second insulating layers, respectively, such that said at least one electrifiable conductor is at least substantially entrapped by said first and second return conductors. The first connector may be operable to connect the conductors of the elongated cord to a line side input, and the second connector may be operable to connect the conductors of the elongated cord to a load.

Another embodiment may provide an extension cord system that includes an extension cord and a housing for the extension cord. The extension cord may include at least one electrifiable conductor for delivering electrical power, first and second insulating layers formed on opposing sides of the at least one electrifiable conductor, and first and second return conductors formed on the first and second insulating layers, respectively, such that said at least one electrifiable conductor is at least substantially entrapped by said first and second return conductors. The housing may include one or more components that define an interior portion in which at least a portion of the extension cord may be housed. An opening may be defined in the one or more components through which an un-housed portion of the extension cord may be extended. The housing may also include a spooling mechanism and a connector. The spooling mechanism may be operable to wind up the at least a portion of the extension cord that is housed within the housing. The connector may be operable to connect the conductors of the extension cord to a line side input.

Additional extension cords, apparatus, systems, methods, and features are realized through the techniques of various embodiments of the invention. Other embodiments and aspects of the invention are described in detail herein and are considered a part of the claimed invention. Other features can be understood with reference to the description and to the drawings.

BRIEF DESCRIPTION OF THE DRAWINGS

The foregoing, and other aspects, and embodiments will be better understood from the following detailed description of the exemplary embodiments of the invention with reference to the drawings, in which.

DETAILED DESCRIPTION

Example embodiments of the invention now will be described more fully hereinafter with reference to the accompanying drawings, in which embodiments of the invention are shown. This invention may, however, be embodied in many different forms and should not be construed as limited to the embodiments set forth herein, rather, these embodiments are provided so that this disclosure will be thorough and complete, and will fully convey the scope of the invention to those skilled in the art. Like numbers refer to like elements throughout.

In accordance with example embodiments of the invention, flat wire extension cords and flat wire extension cord systems and apparatuses are provided. Additionally, methods of fabricating the flat wire extension cords and flat wire extension cord systems are provided. One example flat wire extension cord may include an elongated cord portion that includes at least one electrifiable conductor, and first and second return conductors which are respectively formed on opposing sides of the at least one electrifiable conductor, such that the at least one electrifiable conductor is at least substantially entrapped by the first and second return conductors. The elongated cord portion may also include one or more insulating layers between the various conductors and/or around the various conductors. The example flat wire extension cord may further include connection means on a first end that facilitate connecting the flat wire extension cord to a power source and connection means on a distal end that facilitate the connection of an electrical load to the flat wire extension cord. In this regard, electrical power may be provided from the power source to the load via the flat wire extension cord.

Figure 2:
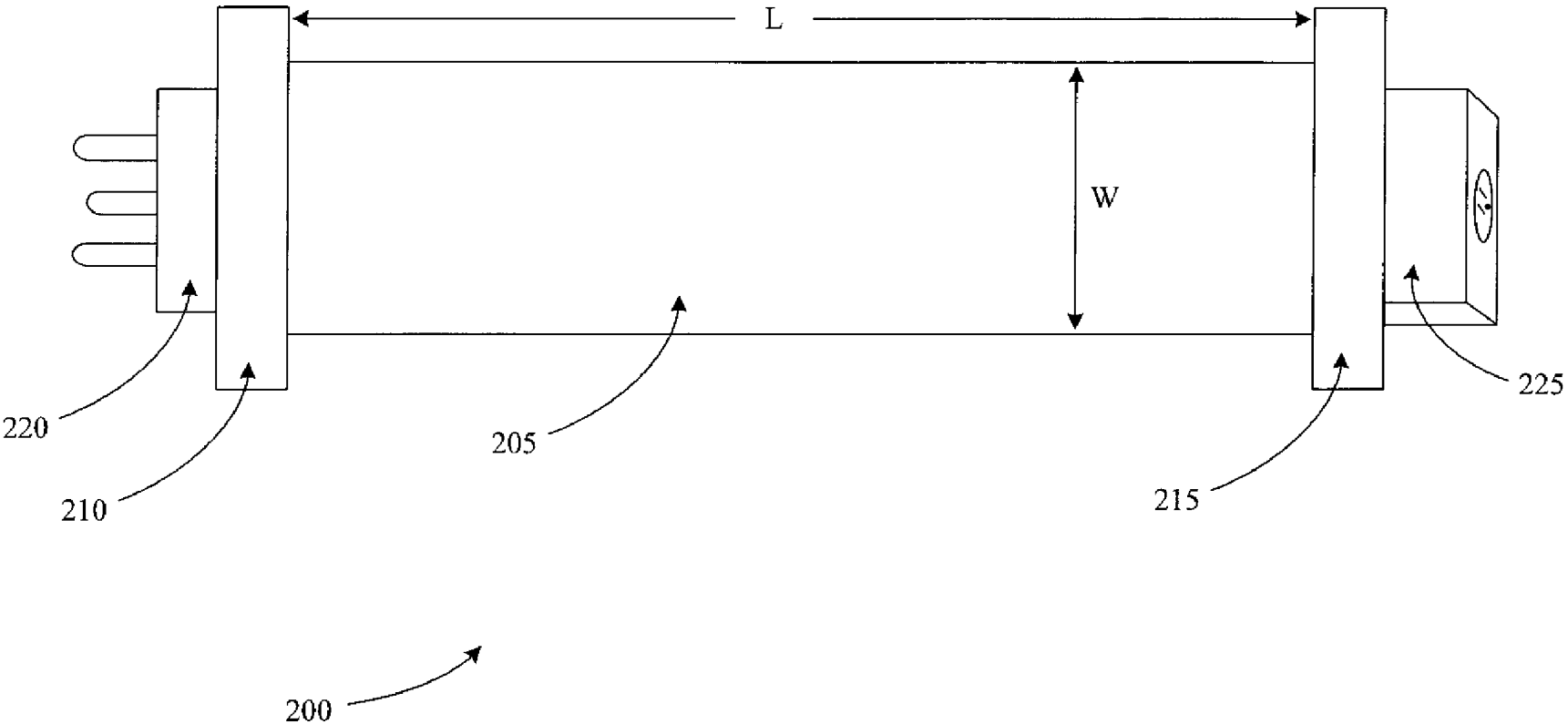
FIG. 2 is a top view of one example extension cord in accordance with an illustrative embodiment of the invention.

With reference to FIG. 2, one example of a flat wire extension cord 200 is provided in accordance with an illustrative embodiment of the invention. The flat wire extension cord 200 may include an elongated cord portion 205, and suitable connectors 210, 215 situated at distal ends of the elongated cord portion 205. The elongated cord portion 205 may include one or more conductors that facilitate the communication of signals, such as an electrical power signal, over the elongated cord portion 205. A first connector 210 may facilitate the connection of the one or more conductors of the elongated cord portion 205 to an electrical power source. The second connector 215 may facilitate the connection of the one or more conductors of the elongated cord portion 205 to one or more electrical loads.

The elongated cord portion 205 may include any suitable flat wire or combination of flat wires as desired in various embodiments of the invention. For example, the elongated cord portion 205 may be a flat electrical wire or other flat wire such as a speaker wire, telephone wire, low voltage wire, CATV (cable television) wire, or under surface wire. The elongated cord portion 205 typically will be made up of multiple flat conductors that may be configured in a stacked, multi-planar, or protective layered arrangement or in a parallel or coplanar arrangement having conductors within the same plane. Additionally, the conductors of the elongated cord portion 205 may contain multiple conductive adjacent or non-insulated sub-layers or flat strands. According to one embodiment, the elongated cord portion 205 may include a flat electrical wire that facilitates the delivery of electrical power. One example construction of an elongated cord portion 205 for delivering electrical power is described in greater detail below with reference to FIG. 3.

According to an aspect of the invention, the elongated cord portion 205 may include one or more flat conductors. In this regard, the elongated cord portion 205 may have a relative small overall thickness as desired in various embodiments of the invention. For example, in one embodiment, the elongated cord portion 205 may have an overall thickness of less than approximately 0.050 inches. A flat construction and a relatively small overall thickness of the elongated cord portion 205 permit the elongated cord portion to lie flat against a flat surface, such as, the floor, a wall, etc. Additionally, the flat construction and the relatively small overall thickness may help to minimize the risk that an individual or object catches, snags, or trips over the elongated cord portion 205. Additionally, in certain embodiments of the invention, the edges of the elongated cord portion may be tapered, thereby further minimizing the risk that an individual or object catches, snags, or trips over the elongated cord portion 205. Additionally, in certain embodiments of the invention, the elongated cord portion 205 may have a concave shape. For example, the elongated cord portion 205 malt include one or more conductor and/or one or more support members having a concave shape. The concave shape may facilitate biasing of the elongated cord portion 205 to add longitudinal stiffness, allotting the elongated cord portion 205 to be flat and easily moved. Additionally, in certain embodiments of the invention, such as that discussed below with reference to FIG. 5, the concave shape may facilitate greater ease in extending and retracting the elongated cord portion 205 from a housing.

According to certain embodiments of the invention, the elongated cord portion 205 may be relatively flexible. A relatively flexible elongated cord portion 205 may facilitate extension of the elongated cord portion 205 across several surfaces. As an example, a flexible elongated cord portion 205 may be extended from a power source (e.g., wall outlet) across a floor to a work bench and then to an electrical load situated at the work bench. Additionally, a relatively flexible elongated cord portion 205 may facilitate easy storage of the flat wire extension cord 200. Furthermore, a relatively flexible elongated cord portion 205 may facilitate changes of direction of the flat wire extension cord 200 on any surface. In one embodiment, the elongated cord portion 205 may be flexible such that it accommodates angular changes in any direction. For example, the elongated cord portion 205 may be folded over itself to facilitate a turn on a flat surface, such as, on the floor. After being folded over itself, the elongated cord portion 205 may still be relatively flat.

With continued reference to FIG. 2, the first connector 210 and the second connector 215 may be any suitable connectors, connection devices, and/or connection means that facilitate connection of the elongated cord portion 205 to a conventional power source, conventional wire, or a conventional electrical load. In this regard, the first connector 210 and the second connector 215 may each be configured to connect the various conductors of the elongated cord portion 205 to the conductors of a conventional power source, conventional wire, or a conventional load. For example, in an embodiment where the elongated cord portion 205 includes five stacked conductors as described below with reference to FIG. 3, the first connector 210 and the second connector 215 may be configured to connect the five stacked conductors of the elongated cord portion 205 to the three conductors included in a conventional power source, conventional wire, or conventional load. Various types of connectors may be utilized as desired to form these connections.

In certain embodiment of the invention, the first connector 210 may facilitate connection of the elongated cord portion 205 to an electrical power source, such as, a conventional electrical power source. The first connector 210 may also be referred to as a line side connector. As shown in FIG. 2, a conventional plug 220 may be connected to the first connector 210 in certain embodiments of the invention. The conventional plug 220 may be a standard two or three-pronged male plug that facilitates connecting the flat wire extension cord 200 to a conventional outlet, such as, a wall outlet or an outlet of a surge protector. In this regard, electrical power may be provided to the flat wire extension cord 200.

Additionally, in certain embodiments of the invention, the second connector 215 may facilitate connection of the elongated cord portion 205 to an electrical load, such as, a conventional electrical load. The second connector 215 may also be referred to as a load side connector. As shown in FIG. 2, one or more conventional outlets 225 may be connected to the second connector 215. Each of the one or more conventional outlets 225 may be a standard two or three-pronged female outlet that facilitates connecting the flat wire extension cord 200 to one or more electrical loads. In this regard, electrical power may be provided to the one or more electrical loads by the flat wire extension cord 200.

The elongated portion 205 of a flat wire extension cord 200 may include a wide variety of different constructions as desired in various embodiments of the invention. Additionally, for the remainder of this disclosure, the elongated portion may also be referred to interchangeably as the flat wire extension cord or as the extension cord.

Figure 3:
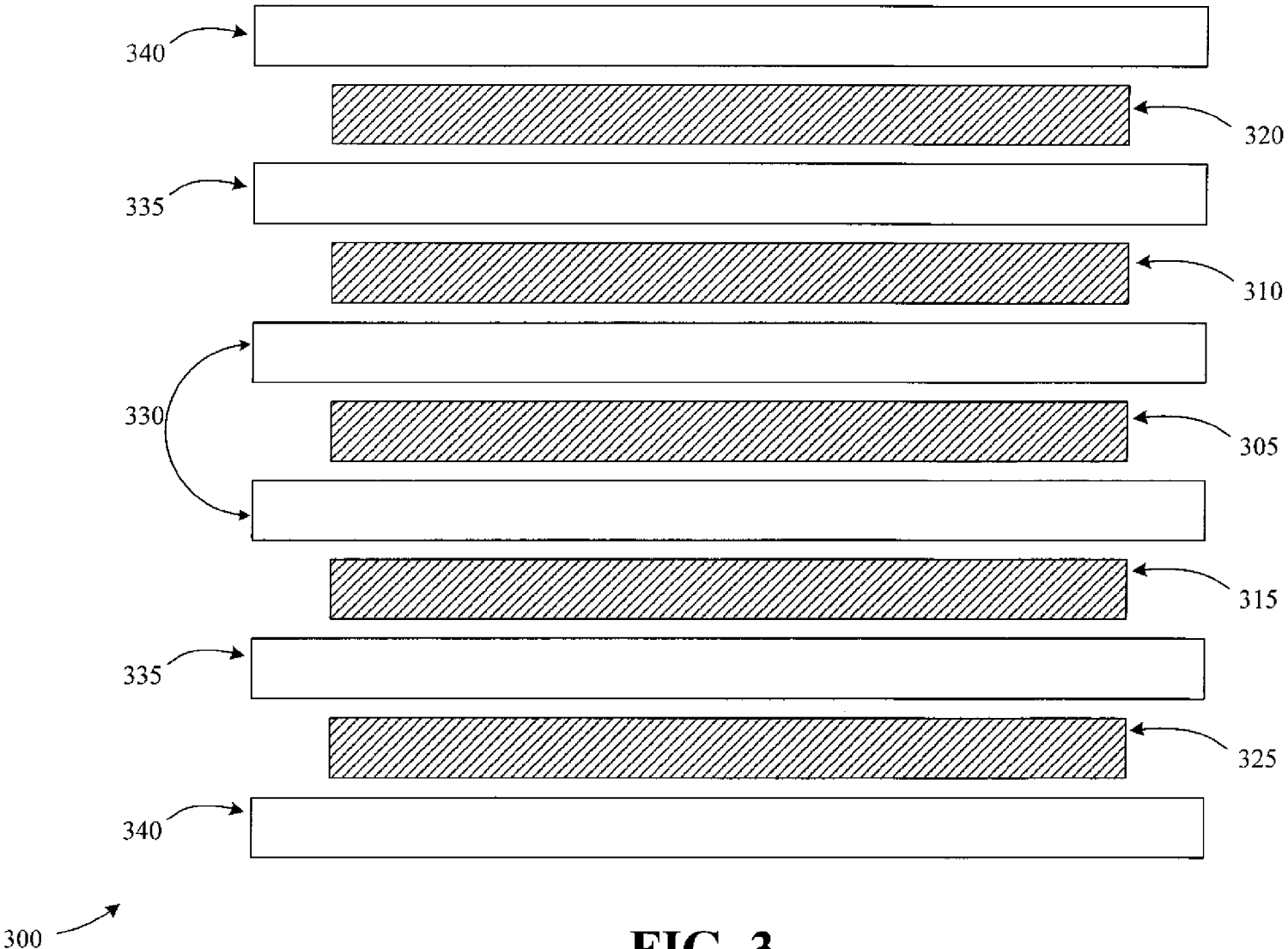
FIG. 3 is a cross-section diagram of one example extension cord in accordance with an illustrative embodiment of the invention.

FIG. 3 is a cross-section diagram of one example extension cord 300 in accordance with an illustrative embodiment of the invention. The example extension cord 300 illustrated in FIG. 3 is a multi-planar flat wire extension cord that includes stacked conductors. At least one electrifiable conductor 305 (or hot conductor) may be situated between two return conductors 310, 315, (or neutral conductors) and the two return conductors 310, 315 may be formed such that the electrifiable conductor 305 is substantially entrapped by the first and second return conductors 310, 315. The term substantially entrapped may be utilized to refer to a situation in which the electrifiable conductor 305 cannot be contacted by a foreign object (e.g., a nail, screw, staple, etc.) without the foreign object first contacting one of the return conductors 310, 315. The term substantially entrapped does not necessarily mean that the return conductors 310, 315 completely surround the electrifiable conductor 305 (although such a design is possible). Instead, the term may mean that any distance between the return conductors 310, 315 may be small enough that a foreign object cannot reasonably go between the return conductors 310, 315 and the electrifiable conductor 305 without contacting one or more of the return conductors 310, 315.

With continued reference to FIG. 3, two grounding conductors 320, 325 may be included in the flat wire extension cord 300. The various conductors of the extension cord 300 may be assembled in a stacked configuration such that the electrifiable conductor 305 is situated between the two return conductors 310, 315 and that three conductor arrangement is then sandwiched between the two grounding conductors 320, 325. This configuration may be referred to as a G-N-H-N-G configuration.

Additionally, insulation material may be disposed between each of the conductors of the flat wire extension cord 300. The insulation material may prevent the various conductors of the extension cord 300 from contacting one another and creating a short circuit in the extension cord 300. Electrifiable conductor insulation material 330 may surround the electrifiable conductor 305 and prevent the electrifiable conductor 305 from making electrical contact with the other conductors of the extension cord 300. Additionally, return conductor insulation material 335 may be disposed between the return conductors 310, 315 and the corresponding grounding conductors 320, 325 to prevent the first return conductor 310 from contacting the corresponding first grounding conductor 320 and to prevent the second return conductor 315 from contacting the corresponding second grounding conductor 325. Grounding conductor insulation 340 may be disposed opposite the first grounding conductor 320 and the second grounding conductor 325, and the grounding conductor insulation 340 may prevent the grounding conductors 320, 325 from contacting an object or surface that is external to the flat wire extension cord 300.

In another embodiment, each conductor of the extension cord 300 may be individually wrapped with an insulation material. In this alternative configuration, electrifiable conductor insulation material 330 would be disposed on both sides of the electrifiable conductor 305 to separate the electrifiable conductor 305 from the return conductors 310, 315. Return conductor insulation material 335 would be disposed on both sides of each of the return conductors 310, 315 to separate the return conductors 310, 315 from the electrifiable conductor 305 and the grounding conductors 320, 325. Grounding conductor insulation material 340 may be disposed on both sides of each of the grounding conductors 320, 325 to separate the grounding conductors 320, 325 from the return conductors 310, 315 and any objects or surfaces that are external to the extension cord 300. In one configuration, two layers of insulation material may be disposed between any two conductors of the extension cord 300, thereby, decreasing the possibility of short circuits between the conductors of the extension cord 300. In other words, a short circuit between two conductors of the extension cord 300 exists when there is a flaw in the insulation material between the two conductors. For example, if only a single layer of insulation material is disposed between each of the conductors of the extension cord 300, a short circuit might occur if there is a flaw in the insulation material disposed between the electrifiable conductor 305 and one of the return conductors 310. If, however, each of the conductors of the extension cord 300 is individually wrapped with insulation material, the possibility of a short circuit between two conductors is decreased because flaws would need to be present in both layers of insulation material disposed between the two conductors, and the flaws would need to line up with one another or be situated in close proximity to one another. For example, for a short circuit to occur between the electrifiable conductor 305 and one of the return conductors 310, flaws must be present in both the electrifiable conductor insulation material 330 and in the return conductor insulation material 335 disposed between the two conductors. Additionally, these flaws would need to line up with one another or be situated in close proximity to one another.

Although a five-conductor stacked flat wire extension cord 300 is depicted in FIG. 3, other conductor configurations may be utilized as desired in various embodiments of the invention. For example, flat wire extension cords with a wide variety of stacked conductor configurations may be utilized. As an example, a three conductor flat wire extension cord having a stacked configuration may be utilized in certain embodiments of the invention. The three conductor extension cord may include an electrifiable conductor that is substantially entrapped by first and second return conductors, and the three conductor configuration may be referred to as a N-H-N configuration. Additionally, various extension cord embodiments containing parallel or coplanar arrangements of conductors may be utilized. For example, a three conductor flat wire extension cord having a coplanar arrangement may be utilized in certain embodiments of the invention. The three conductor coplanar flat wire extension cord may include an electrifiable conductor, a return conductor, and a grounding conductor disposed in a parallel configuration within the same plane.

Figure 4:
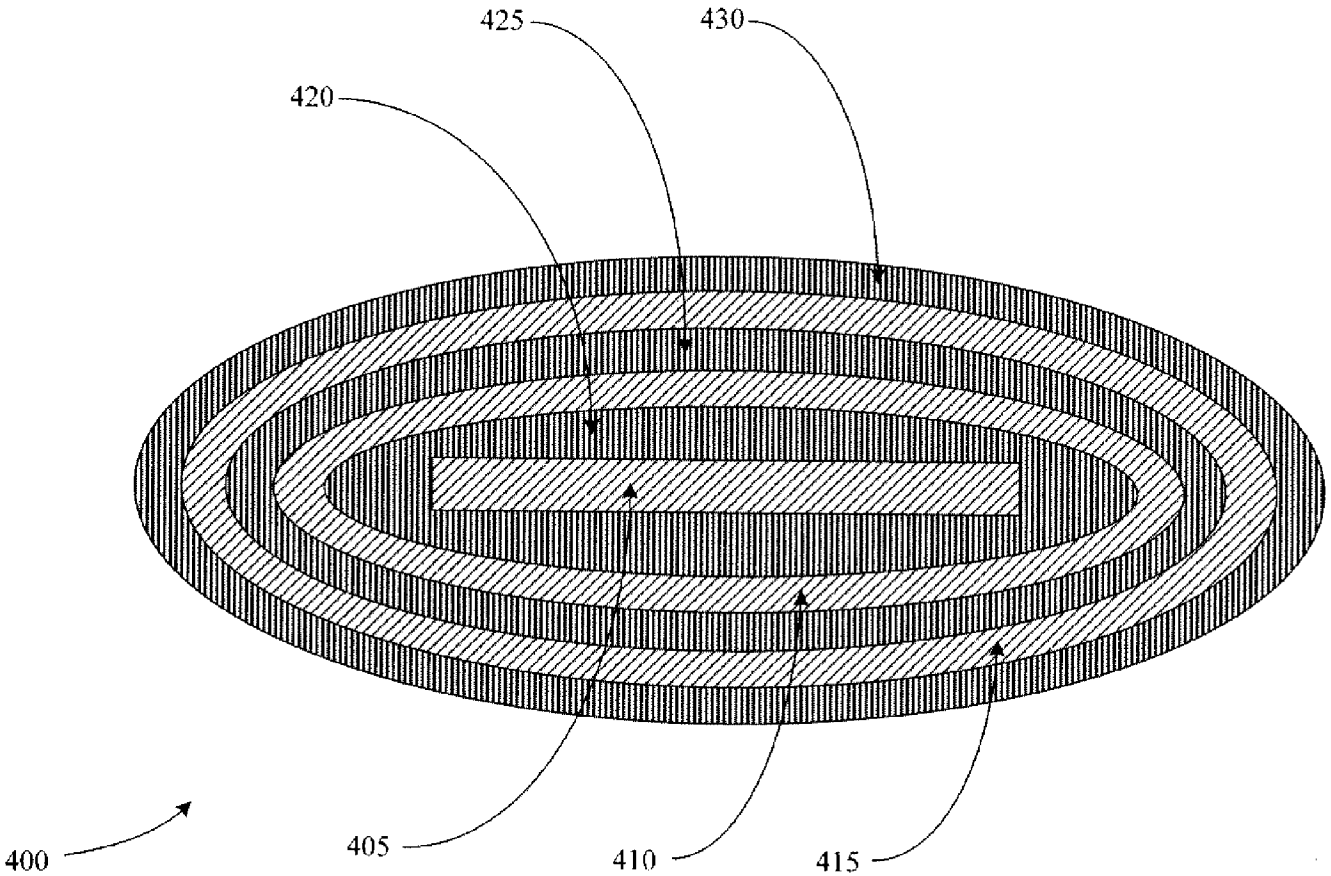
FIG. 4 is a cross-section diagram of another example extension cord in accordance with an illustrative embodiment of the invention.

FIG. 4 is a cross-section diagram of another example flat wire extension cord 400 in accordance with an illustrative embodiment of the invention. The extension cord 400 depicted in FIG. 4 may include an electrifiable conductor 405 that is completely entrapped by a return conductor 410 that is formed around the electrifiable conductor 405. Additionally, in certain embodiments, a grounding conductor 415 may be formed around the return conductor 410. Insulation material may be disposed as desired between the various conductors 405, 410, 415 and/or around the grounding conductor 415. As shown in FIG. 4, first insulation material 420 may be disposed between the electrifiable conductor 405 and the return conductor 410, second insulation material 425 may be disposed between the return conductor 410 and the grounding conductor, and third insulation material 430 may be disposed around the grounding conductor 415.

A wide variety of other flat wire constructions may be utilized as desired in various embodiments of the invention. Additionally, it should be noted that unless otherwise noted, any of the layers (e.g., conductors, insulating layers, etc.) in the various embodiments discussed herein may be formed of a plurality of layers. Thus, for example, insulating layer 330 or 420 should be construed as at least one insulating layer 330 or 420, an electrifiable conductor should be construed to mean at least one (e.g., a plurality of) electrifiable conductor, and so on.

In various embodiments of the invention, a flat wire extension cord, such as flat wire extension cord 300, may also include a suitable adhesive for bonding adjacent insulation layers and conductors in the flat wire extension cord.

It should be noted that the drawings of example flat wire extension cords are intended to be illustrative. In an actual flat wire extension cord in accordance with an embodiment of the invention, there may be no visible spacings (e.g., the white areas in FIG. 3) between the conductors, insulation, and adhesives components, each of which is described further below.

Flat wire extension cords in accordance with various embodiments of the invention may be used for a basically unlimited range of voltage applications (e.g., 0V to 240V and higher). For example, an extension cord may include a Class 1 or Class 2 capability and other low voltage/current capabilities, and may be used for commercially available utility voltages such as 120V AC and 240V AC, and may be used for other applications other than Class 1 or Class 2, or these commercially available voltages.

As illustrated in FIG. 2, a flat wire extension cord 200 may have a longitudinal (e.g., lengthwise) direction, L, and a transverse (e.g., widthwise) direction, W. These directions may also be referred to as a horizontal dimension of the extension cord. The extension cord may further be considered as having a thickness (e.g., a total thickness of all of the stacked layers) which may be referred to as a vertical dimension.

Additionally, as shown in FIG. 2, in various embodiments of the invention, a flat wire extension cord, such as extension cord 200, may also include terminal portions (e.g., terminations) formed at the ends of the extension cord 200 in the longitudinal direction. For example, one end (e.g., terminal portion) of the extension cord 200 may be connected to a source or a source module (e.g., power source, voice/data transmission source, etc.) and the other end (e.g., terminal portion) may be connected to a destination or destination module (e.g., electronic device, electrical load, etc.). It should be noted that certain embodiments do not necessarily include any particular form termination (e.g., current source, earth ground, etc.) but may include a longitudinal portion of wire formed between two termination points.

As further illustrated, for example, in FIG. 3, the first and second return conductors 310, 315 may be formed such that the at least one electrifiable conductor, such as 305, is at least substantially entrapped (e.g., enveloped, surrounded, encased) by the first and second return conductors 310, 315. By "substantially entrapped" it is meant that for all practical purposes, the electrifiable conductor 305 may not be contacted with a foreign object (e.g., a nail, screw, staple, etc.) without first touching the one of the return conductors 310, 315. The term "substantially entrapped" does not necessarily mean that the return conductors 310, 315 completely surround the electrifiable conductor (although such a design is possible). Instead, it means that any distance between the return conductors 310, 315 and the electrifiable conductor 305 (e.g., the thickness of an insulating layer between the electrifiable conductor and a return conductor) is so small (e.g., about 0.030 inches or less) that such a foreign object cannot reasonably go between the return conductors 310, 315 and the electrifiable conductor 305 without touching the return conductors 310, 315.

In certain embodiments of the invention, for example, as illustrated in FIG. 3, the flat wire extension cord 300 may be formed of layers (e.g., substantially flat layers) having a stacked configuration. At least some of these layers (e.g., return conductor 310, insulating layers 335) may be brought together (e.g., mated together by crimped, bonded, etc.) along the longitudinal edges of the flat wire extension cord 300.

One man note that there may remain a distance, S, between the return conductor layers, for example, return conductor layers 310, 315. That is, the electrifiable conductor 305 does not have to be completely entrapped by the return conductors 310, 315. In this manner, so long as any distance between the return conductors 310, 315 and the electrifiable conductor 305 (e.g., the thickness of an insulating layer between the electrifiable conductor and a return conductor) is sufficiently small (e.g., about 0.030 inches or less), an object cannot likely penetrate the flat wire extension cord 300 and contact the electrifiable conductor 305 without first contacting a return conductor 310, 315.

Further, the electrifiable conductor 305 may be at least "substantially entrapped" along the longitudinal portion of the flat wire extension cord 300. That is, at the terminal portions of the flat wire extension cord 300, the electrifiable conductor 305 may be exposed and not entrapped, for connection to a device (e.g., a source or destination).

It should also be noted that the term "electrifiable" is intended to mean having a capability (e.g., purpose) of connecting to a source or electrical current and carrying (e.g., delivering) an electrical current or electrical signal (e.g., an AC or DC power supply or an electrical communication signal such as a voice or data transmission signal). An electrifiable conductor may be referred to as the "non-return conductor". An electrifiable conductor may also be referred to as a "hot conductor". Further, the term "return" is intended to mean having a purpose of returning an electrical current (e.g., not having a purpose of delivering an electrical current or electrical power supply to a load). A return conductor may also be referred to as a grounded conductor or a neutral conductor.

Specifically, an "electrifiable" conductor may be considered any conductor within the "hot zone" as defined herein. The electrifiable conductor (e.g., a conductor in the hot zone) may be the "hot" conductor in operation but not necessarily. For example, with regards to a 3-way switch, the electrifiable conductor (e.g., a conductor in the "hot zone") may in one condition, act as a hot conductor, but in another condition act as a ground conductor.

In addition, the term "grounding" is intended to mean having a capability or purpose of connecting to "earth ground". A grounding conductor may also be referred to as simply a "ground conductor" or "grounded conductor." The grounding conductor is not intended to have any return current on it. Further, the term "conductor" is defined to mean a conductive medium which is capable of carrying an electrical current.

In general, embodiments of the flat wire extension cord may provide an alternative which can be applied in a variety of ways and in a variety of locations and represents a paradigm shift for most other types of electrical extension cords. The flat wire extension cord may include protective layered wire which can have conductors with a parallel longitudinal axis (e.g., conductors having a curvilinear cross-section), or the wire may be substantially stacked in nature, such that each conductor has a substantially parallel plane (e.g., parallel axis). However, the conductor cross-section is not necessarily coincidental (e.g., concentric) or coaxial.

For example, in one aspect, an inner (hot) conductor is surrounded or bounded by an insulator, then an intermediate (neutral) conductor, a second insulator, then an outer (grounding) conductor, and an outer insulator.

Example embodiments of the flat wire extension cord can have cross-sectional shapes ranging from a substantially curvilinear geometry such circles (e.g., concentric circles), ovals, ellipses, or flat (e.g., linear or rectilinear) layers. The concentric format (e.g., major and minor axes approximately equal) is symmetric with an innermost conductor (e.g., hot/electrifiable) having relatively small surface area. The oval or ellipsoid format (e.g., major and minor axis unequal) supports a relatively flat innermost conductor. The flat format (major axis=1, minor axis=0) supports all flat conductors and insulators (e.g., multi-planar flat conductor wire).

Example embodiments of the flat wire extension cord may offer differing features regarding safety, application methodology, cost, and ease of manufacture. The concentric and oval formats may, have relatively exceptional safety aspects (e.g., a very low penetration hazard). Whereas, the flat format has a relatively exceptional current carrying capability due to a large surface area of each conductor and would likely trip any safety disconnect device (e.g., breaker, GFCI, etc.) in any case of penetration. Further, the use of relatively flat embodiments of the flat wire extension cord (e.g., protective layered wire) can provide improvements in safety, electrical interference shielding, and flammability over conventional electrical cords.

Regarding the risk of electrocution, the inevitable issue centers around penetration of an electrified conductor (e.g., an electrifiable conductor) by objects such as nails, screws, drill bits, etc. Traditional extension cords have the potential for penetration by any of the aforementioned objects with a possibility of electrocution as a result.

Although embodiments of the flat wire extension cord may be surface mounted (e.g., on a floor, wall, ceiling, etc.), such embodiments offer improvements over certain conventional wire by assuring that the penetrating object first passes through at least one non-electrifiable conductor (e.g., a return conductor and/or a grounding conductor) prior to any contact with the electrifiable (e.g., hot/innermost) conductor. Thus, as the penetration motion proceeds, high currents on hot through the ground and neutral are generated causing a circuit breaker to expeditiously trip.

Specifically, with respect to this penetration dynamics solution of the flat wire extension cord (e.g., stacked electrical wire), to reduce the chance for electrification of a penetrating object, conductor thickness of the electrifiable conductor (e.g., hot conductor) should be low (e.g., as low as possible) relative to the total thickness of the outer layers (e.g., grounding conductors and return conductors). A good layer thickness ratio, R, of 1.00 has been demonstrated through test results, whereby $R=(T_G+T_N)/T_H=1.00$, where $T_G$, $T_N$, and $T_H$ are the conductor thickness of the Grounding, Grounded, and Electrifiable conductors, respectively, and R is the Layer Thickness Ratio. For example, in one example embodiment, the thickness of the grounding and return conductors was about 0.001", and the thickness of the electrifiable conductor was about 0.002, such that the ratio $R=(T_G+T_N)/T_H=(0.001"+0.001")/0.002"=1.00$.

Further, in the penetration dynamics of a flat wire extension cord, the opposing Grounded and Grounding layers may also contribute favorably to the ratio, R, resulting in a relatively safer condition. It has been shown that the higher the ratio R is, the safer the extension cord is during a penetration with a conductive object such as a nail.

During a short circuit, the flat wire extension cord may act as a voltage divider from the source to the point of penetration. The layer thickness ratio produces a ratio-metric scaling of the voltage that is applied from within to the penetrating object. Therefore, the safer condition results from the lower voltage at the nail, etc.

During a penetration, to increase the probability of actuation and to decrease the actuation time of a safety device (e.g., circuit breaker, circuit interrupter (e.g., GFCI) or other safety disconnect device), the conductor thickness of the outer (e.g., grounding and return conductors) layers may be substantial enough to cause a reliable short circuit at the point of penetration. The short circuit may result in high currents that cause the safety devices to trip at their fastest response time. This results in a safer condition based on time. The combination of lower voltage and shorter time produces a significantly safer condition than either condition by itself.

At the point of penetration, after the safety device has removed from the power supply, it can be assumed that all layers remain in a relatively low resistance relationship. This is due to the presence of the penetrating object and/or the insulation displacement damage of the various layers. Furthermore, the flashpoint of the penetration may cause somewhat of a melded or fused area in the perimeter of the penetration. With repeated application of power into the damaged area, the perimeter may increase (e.g., especially if the penetrating object has been removed) in size but sufficient resistance will be residual enough to repeat reactivations of the safety device upon being reset. A few examples of the penetration dynamics of a flat wire extension cord are discussed in greater detail below with reference to FIGS. 9 and 10.

One way to avoid repeated application of power into the damaged area could be to have a circuit within an Active Safety Device (ASD) that can detect a substantially shorted return to grounding conductors prior to applying power to the electrical wire. This feature capability is supported by the design of the flat wire extension cord. Examples of suitable ASD's are described in greater detail in co-pending U.S. application Ser. No. 11/782,450, filed Jul. 24, 2007, entitled "Electrical Safety Devices and Systems for Use with Electrical Wiring, and Methods for Using Same," the disclosure of which is incorporated by reference herein in its entirety.

Therefore, embodiments of the flat wire extension cord may be considered inherently safe with a circuit breaker or fuse. In addition, the safety can be further improved when the wire is used in conjunction with a safety device (e.g., circuit breaker, circuit interrupter (e.g., ground fault circuit interrupter (GFCI)) or other safety disconnect device).

Certain embodiments of the invention also provide improvements with respect to other electrical safety issues, such as frayed insulation allowing incidental contact and possible electrocution. Such issues can be addressed by certain embodiments of the invention (e.g., protective layered electrical wire), for example, providing at least three layers of insulation between the hot conductor and the outside world (in any direction). This is commonly referred to as "triple-insulated" as opposed to contemporary double-insulated conventional wire.

Regarding electrical shielding, the outer grounding layer of embodiments of the flat wire extension cord may provide a shield whereby power transmission signals or load-generated electrical noise cannot pass through the cable, or are otherwise minimized, to prevent or otherwise reduce interference with broadcast signals or to cause "hum" in audio equipment.

In addition, regarding flammability, certain embodiments of the flat wire extension cord can offer improvements over conventional extension cords, electrical wires and wiring systems. Specifically, embodiments of the flat wire extension cord may provide a relatively large surface area for dissipating heat. Thus, the outer conductor(s) (e.g., return and grounding conductors) may easily conduct heat away from film insulation being heated from an external source, reducing the risk of fire caused by the heat. Further, the rate of heat transfer may exceed the combustion rate, thus quenching a localized combustion area.

Additional "layers of protection" can be added to a flat wire extension cord as desired in various embodiments of the invention. For example, in addition to an electrical wire (e.g., protective layered wire) and circuit breaker configuration, a GFCI, arc fault detector, and specially developed "active safety devices" may also be included and used with the flat wire extension cord to further reduce the probability of shock, electrocution or fire.

In addition, since the electrifiable conductor may be provided between (e.g., within) the return and grounding conductors, the return and grounding conductors and the insulation layers may provide abrasion protection for the electrifiable conductor. That is, the layers formed on the electrifiable conductor (e.g., insulation layers, return conductor and grounding conductor) may inhibit abrasion of the electrifiable conductor.

Further, embodiments of the flat wire extension cord may include a flat, flexible, wire that allows the user to bring electricity to any area in a room. The electrical wire may be relatively thin (e.g., having a total thickness of no more than 0.050 inches) and can be extended over a floor and/or mounted to the surface of a wall, ceiling or floor.

Each of the conductors in a flat wire extension cord may include one or a plurality of conductive layers (e.g., conductive copper, aluminum or other conductive material layers) which are each about 0.0004 to about 0.020 inches thick, and in some instances on the order of about 0.001 inches thick or less.

The conductors may be formed of a variety of materials and have a variety of patterns, dimensions and spacings. For example, the conductors may be formed of an electrically conductive material such as metal (e.g., copper, aluminum, silver, other conductive materials, etc.), polysilicon, ceramic material, carbon fiber, or conductive ink. Further, the conductors may be relatively thin.

The conductor thickness may be consistent across its length and width, thereby eliminating any resistance "hot spots". The current carrying specifications of a particular application may be accomplished in any of three ways, either individually or in combination. First, the width of the conductors may be varied. Second, additional thin conductive layers (e.g., copper, aluminum or other conductive material) may be stacked for each conductor. Third, the thickness of the conductor may be increased.

For example, in one example load and current application, each conductor may include about two conductive layers (e.g., copper, aluminum or other conductive material layers). It is understood, however, that utilizing more or less layers, for each of the below disclosed embodiments, is within the scope of the invention.

The insulating lay ers in a flat wire extension cord may be formed of a variety of suitable materials as desired. For example, the insulating layers may include a polymeric material (e.g., polypropylene film, polyester film, polyethylene film, etc.). Further, the insulating layers may have a thickness, for example, in a range of about 0.00025 to about 0.030 inches.

The insulation or insulating layers formed between the conductors may also orient the conductive layers. In addition, the insulation material may be used alone, or in combination with the internal adhesive, to separate the conductors and maintain a safe distance between conductors of different purposes (e.g., grounding vs return or electrifiable (e.g., hot)). Further, the flat wire extension cord may have tapered edges (e.g., tapered in a transverse width direction) to facilitate placing the flat wire extension cord on a floor or other flat surface such that tripping over the extension cord or catching or snagging object on the flat wire extension cord may be avoided. For example, the layers (e.g., conductor layers and/or insulation layers) may have different widths to facilitate such a tapered edge.

Insulation materials utilized in certain embodiments of the invention should withstand tensile forces applied in the fabrication process, not retract or relax under storage conditions, and be removable when its use is completed. An) abrasion, cracking, cutting, piercing, or any other insulation damage (e.g., damage that would render an unsafe exposure to bodily harm or damage, or physical or construction damage, such as to a structure) will be made safe using electronic means of failure detection that will disconnect potentially harmful or damaging currents from the user in a time frame that will prevent permanent harm.

Further, adhesive material may be able to bond to the insulation layers and the conductors of a flat wire extension cord. For example, adhesive tape, liquid adhesive, thermal adhesive, pressure-sensitive adhesive or UV sensitive adhesive or a combination of any such adhesives or adhering methods, may be used as an internal adhesive. The internal adhesive material may also function to separate the conductive layer groups and maintain a safe dielectric distance between conductors of different purposes.

In addition, various embodiments of the flat wire extension cord may include one or more conductors operable to transmit electrical communication signals such as voice and data transmission signals. For example, the flat wire extension cord may be used as part of power line carrier (PLC) communication system in which the flat wire extension cord (e.g., a portion of the flat wire extension cord) is used to provide AC electrical power, and is also used (e.g., a portion of the flat wire extension cord is used) as a network medium to transmit voice and/or data communication signals. Thus, the flat wire extension cord may be used to provide high speed network access points wherever there is an AC electrical outlet.

Specifically, embodiments of the flat wire extension cord may transmit electrical communication signals during the time proximity of zero-crossing of an AC power supply. In addition, there can be many different types (e.g., formats) of communication signals transmitted by the flat wire extension cord including RS485, HDTV, etc., according to embodiments of the invention.

It should be noted that the electrical flat wire extension cord according to the example embodiments of the invention may be used for transmitting communication signals independently of any electrical current. That is, the electrifiable conductors may be dedicated entirely to communication signals or entirely to an electrical power supply.

In an example embodiment, power may originate at a line side, such as a line side connected to a first connector 210 of the electrical flat wire extension cord 200 shown in FIG. 2. The electrical power may be delivered to a load side, such as a load side connected to the second connector 215 of the electrical flat wire extension cord 200. The line side power may typically be originated via a common receptacle or other source (e.g., a conventional source). A wide variety of different termination techniques and/or connectors may be utilized as desired at either end of the electrical flat wire extension cord 200.

Another aspect of various embodiments of the flat wire extension cord, such as flat wire extension cord 300, is that a capacitance solution may be provided. That is, the capacitance resulting from the electrifiable conductor 305 which may, be in close proximity to a return conductor 310, 315, may represent a reactive current in superposition with any load current. This capacitance is charged based on the applied voltage (e.g., AC or DC). Since the return conductor 310, 315 has a low voltage relative to the electrifiable conductor 305, tier little charge will be accumulated within any capacitor formed between the return and grounding conductors.

Another aspect of the flat wire extension cord 300 according to various embodiments of the invention, is a bi-directional nature of the "shielding" capability of the grounding (e.g., outer; earth ground) conductors 320, 325. For example, as noted above, the at least one grounding layer inhibits power transmission signals and load-generated electrical noise from being transferred/emitted from the flat wire extension cord. In addition, the shielding provided by the grounding conductors 310 prevents ingress of externally generated electrical noise onto either the return or electrifiable conductors, which is also a valuable feature.

Also, in the interest of safety and communications regarding grounding layers, the two or more grounding conductors 320, 325 (e.g., isolated (outer) grounding layers) in the flat wire extension cord 300 may provide an opportunity to send a communication type signal longitudinally to the other end of the grounding conductor 320, 325, through a wired "jumper" at a destination "module," such as a destination plug that is returned longitudinally to the source. This may be used to provide, for example, a "ground loop continuity check". Thus, various embodiments of the flat wire extension cord 300 may provide the ability to check for continuity by an "Active Safety Device" prior to electrifying the electrifiable conductor or segments of the electrifiable conductor. One practical application for this feature is for providing safety while an electrician terminates exposed destination ends of the electrical wire.

Various embodiments of the flat wire extension cord may be formed by layering (e.g., laminating) the conductors and insulating layers (e.g., substantially conductive and substantially non-conductive mediums (e.g., laminates). Further, laminates including pre-manufactured materials facilitate bulk rolling.

Most electrical wires and electrical extension cords are made by wrapping flat insulators around the axis of a round wire bundle in the form of a helix. Also most individual wires are insulated by having a plastic PVC sheath extruded around the round wire.

The flat wire extension cord according to the various embodiments of the invention, however, ma; include a rolled sheet or foil that is slit to the desired widths. The same is true of the insulating material. Those conductors and insulators which are processed by rolling techniques may then be coated with adhesives that allow the dissimilar materials to be bonded to one another in a continuous feed process. The slitting may occur before the bonding of the dissimilar materials or after, depending on the geometric configuration. For example, in one embodiment of the invention, the insulators and conductors are slit before bonding materials together.

Further, the conductors, such as 305, 310, 315, 320, 325, may be sealed or encapsulated by insulation layers (e.g., individual insulation and/or group insulation) and adhesive may be formed between the insulation layers. The insulators mal, be bonded to the conductors, and overlap the transverse width of the conductors such that insulators may be bonded to insulators. The mutual bonding between insulator materials may create a much stronger and permanent bond, further encapsulating the conductor around the entire cross-sectional periphery. Any number of insulators may exist between conductors. Insulators for individual conductors may end up, beside one another (back to back). In another instance, there can exist a multi-layer combination of insulators for purposes typically having to do with connectorization requirements. In addition, multiple insulator groups (e.g., insulating laminates) which are formed of groups of individual insulators may be placed between any two conductors. A layer of group insulation may also be formed around the structure including the insulator groups and conductors as desired.

When layers of conductors are separated by a layer of insulating material, the possibility exists that a defect in the insulating material may be present. One such defect, in the case of laminates, is an opening (e.g., a pin hole opening) in the insulating material. The opening prevents the intended insulation from occurring and can result in a conductive path in the area of the laminate opening. By placing two laminates or two sheets or two ribbons, (whatever the name for the substantially flat insulating layers), between any two conductors, the statistical likelihood of positioning two openings (e.g., defects) in a coincident position is substantially minimized.

The individually insulated conductors of an example flat wire extension cord may be formed by placing insulating materials in substantially parallel planes with the conductors, and then bonding the insulating materials to the conductor for fixation. Conductors may be grouped together by group insulation. The individually insulated conductors may be joined by possible adhesive or alternate methods of conjoining. This allows the flat wire extension cord to provide for an insulated wire whose adhesive or layered configuration allows for the peeling and folding of individual conductors for purposes of termination.

In various embodiments of the invention, a suitable housing may be provided in conjunction with a flat wire extension cord in order to form an extension cord system. In certain embodiments, the extension cord system may be a portable system that facilitates the use of the flat wire extension cord in a wide variety of environments as desired by a user, for example, in an indoor environment, in a garage, in a work shop, in an automobile or other vehicle, or in an outdoor environment.

Figure 5:
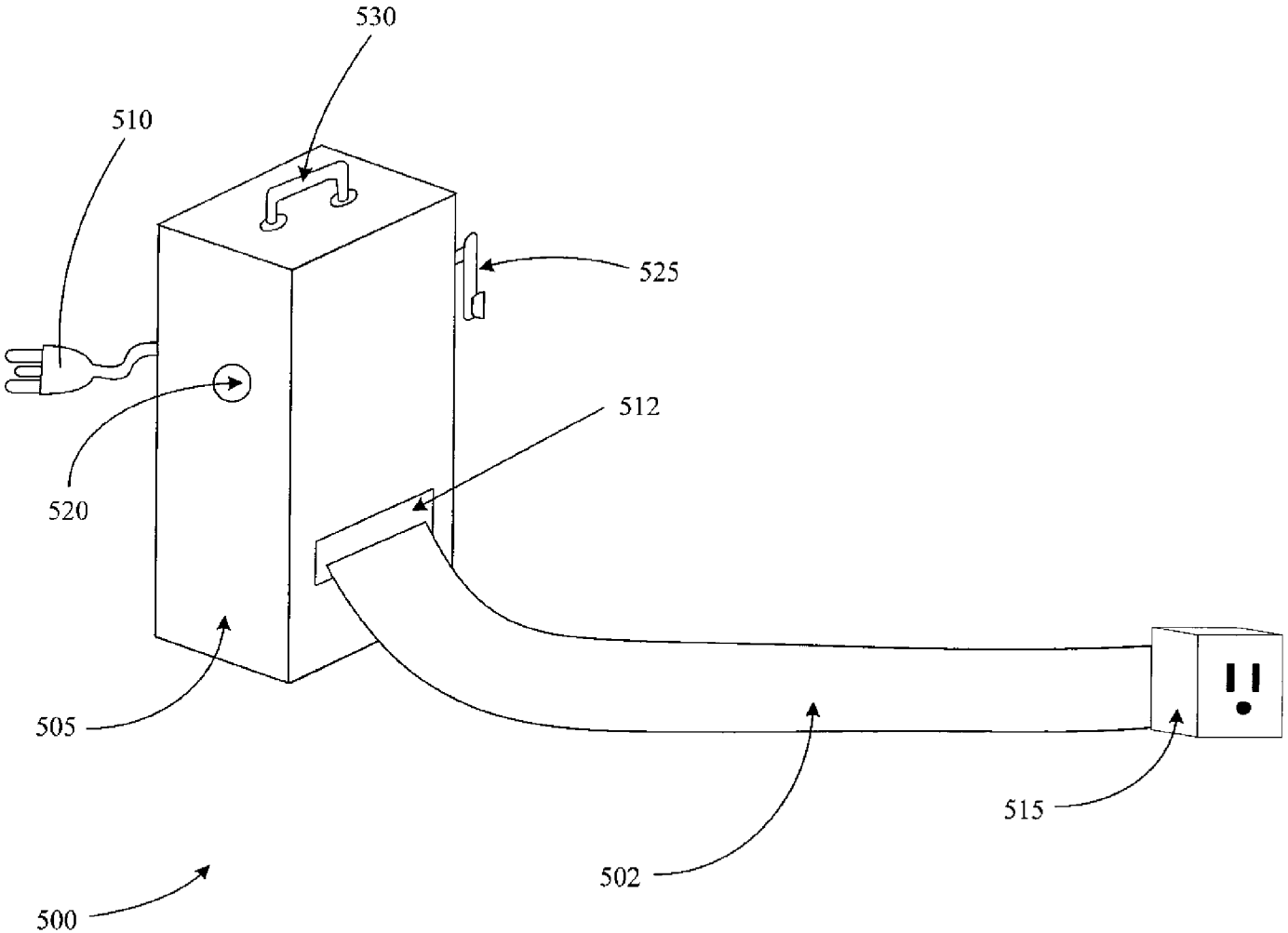
FIG. 5 is a perspective view of one example extension cord system in accordance with an illustrative embodiment of the invention.

FIG. 5 is a perspective view of one example extension cord system 500 in accordance with an illustrative embodiment of the invention. The extension cord system 500 may include a flat wire extension cord 502 and a housing 505. The flat wire extension cord 502 may be at least partially extendible from the housing 505. In this regard, the flat wire extension cord 502 may be extended from the housing 502 in order to supply power to an electrical load that is situated remotely from the housing 505.

Figure 1:
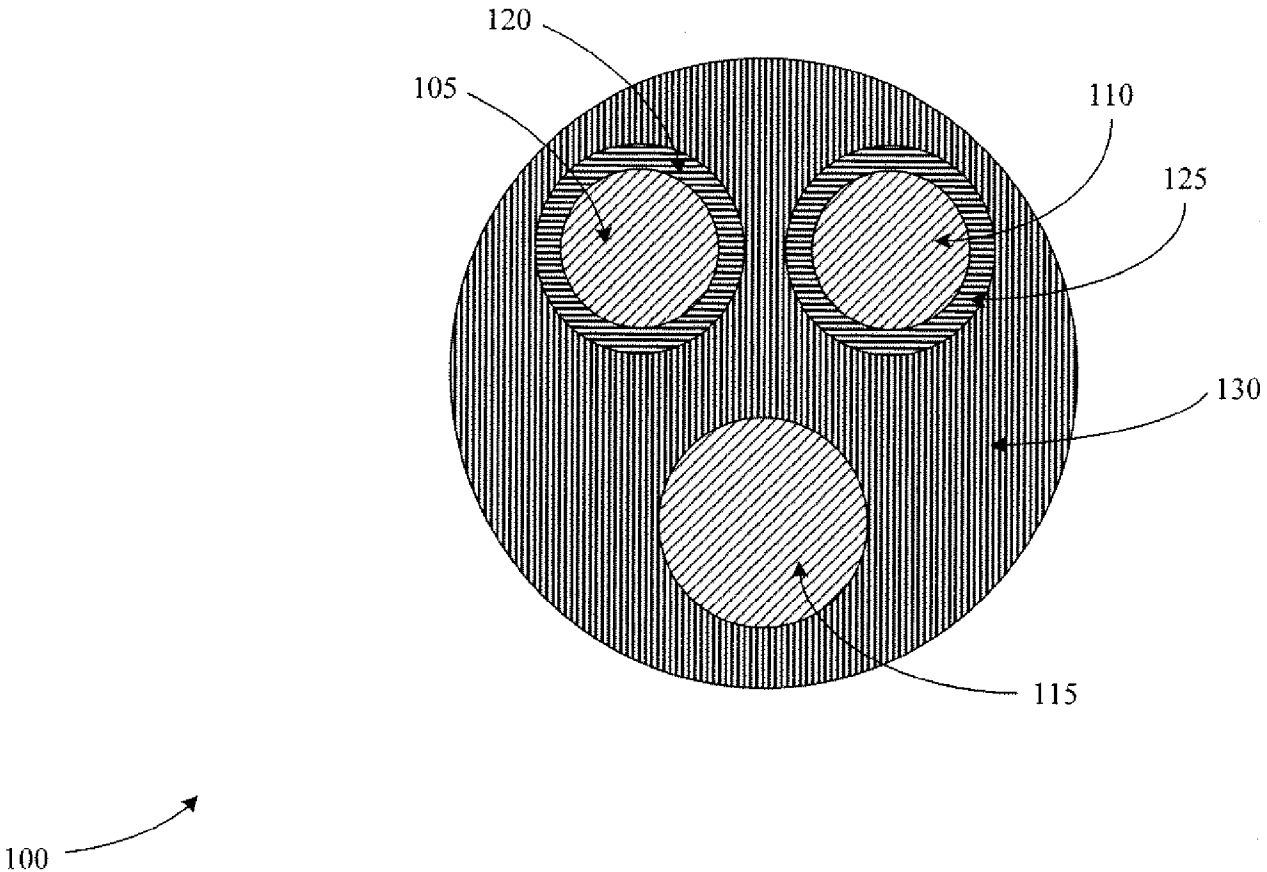
[PRIOR ART] FIG. 1
FIG. 1 is a cross-section diagram of a conventional electrical extension cord.

The housing 505 may include a line side input 510, for example, a conventional electrical plug, that facilitates the communication of a signal, such as an electrical power signal, from a power source onto the flat wire extension cord 502. The signal may be communicated onto the flat wire extension cord 502 via one or more suitable connectors associated with the housing 505. The one or more suitable connectors may facilitate a connection between the line side input 510 and the flat wire extension cord 502. In this regard, the construction of the one or more suitable connectors may be based at least in part on the construction of the line side input 510 and/or on the construction of the flat wire extension cord 502. As an example, given a line side input 510 of a conventional wire, such as the wire 100 illustrated in FIG. 1, and a five-conductor flat wire extension cord 502, such as the flat wire extension cord 300 illustrated in FIG. 3, the one or more suitable connectors may facilitate connection of the three conductors of the line side input to the five conductors of the flat wire extension cord 502. The electrifiable conductor 105 of the line side input 510 may be connected to the electrifiable conductor 305 of the flat wire extension cord 502, the return conductor 110 of the line side input 510 may be connected to the return conductors 310, 315 of the flat wire extension cord 502, and the ground conductor 115 of the line side input 510 may be connected to the ground conductors 320, 325 of the flat wire extension cord 502. Other example connectors are discussed in greater detail below with reference to FIG. 6. Additionally, although the line side input 510 is illustrated as a conventional electrical plug, other types of line side inputs may be utilized as desired in various embodiments of the invention, for example, flat wire, flat wiring, or conventional wire that connects to a cigarette lighter of a vehicle.

In certain embodiments of the invention, the line side input 510 may extend from the housing 505 to facilitate connection of the extension cord system 500 to a power source. For example, as shown in FIG. 5, the line side input 510 may include a conventional electrical wire and/or plug that extends from the housing 505. Although the line side input 510 is illustrated as a conventional wire and/or plug in FIG. 5, other types of line side inputs may be utilized as desired in various embodiments of the invention. For example, a multi-planar flat electrical wire may be utilized as a line side input. As another example, a co-planar flat electrical wire may be utilized as a line side input.

The housing 505 may include a wide variety of different dimensions as desired in various embodiments of the invention. In certain embodiments, the dimensions of the housing 505 may be based at least in part on the dimensions of the flat wire extension cord 502 that may be contained within the housing 505. For example, if a relatively thicker (e.g., heavier gage) flat wire extension cord 502 is associated with the housing 505, then a relatively larger housing 505 may be utilized. As another example, if a relatively longer flat wire extension cord 502 is associated with the housing 505, then a relatively larger housing 505 may be utilized.

Additionally, the housing 505 may be constructed of any number of components as desired in various embodiments of the invention. For example, several components may be connected to define a housing with a hollow region therein in which the flat wire extension cord 502 may be stored. The housing may be constructed of any number of suitable materials or combinations of materials as desired in various embodiments of the invention, including but not limited to, plastic, metal, metal alloys, synthetic materials, composites, etc.

As shown in FIG. 5, the housing 505 may include a slot 512 or opening that facilitates the extension of the flat wire extension cord 502 from the housing 505. In certain embodiments of the invention, the size of the slot 512 may % be based at least in part on the dimensions of the flat wire extension cord 502 associated with the housing 505. One end of the flat wire extension cord 502 may be connected to the line side input 510 within the housing 505, and the opposite end of the flat wire extension cord 502 may be extended from the housing 505 through the slot 512. In one embodiment of the invention, the flat wire extension cord 502 may be contained or stored within the housing 505 when not in use. In use, at least a portion of the flat wire extension cord 502 may be extended from the housing 505 through the slot and a signal, for example, an electrical power signal, may be provided to a load connected to the distal end of the flat wire extension cord 502 that is not contained within the housing 505.

Various types of devices, wires, and/or other electrical loads may be connected to the distal end of the flat wire extension cord 502 that is extended from the housing 505. Example loads include electrical loads, for example, appliances, power tools, etc., other types of flat wiring, conventional wiring, etc. Additionally, in certain embodiments of the invention, a connector 515 may be fixedly or removably attached to the distal end of the flat wire extension cord 502. The connector 515 may facilitate a connection between the flat wire extension cord 502 and a load that is connected thereto. In this regard, a signal, such as an electrical power signal, may be provided to the load. The construction of the connector 515 may be based at least in part on the construction of the flat wire extension cord 502 and/or on the construction of the load. As shown in FIG. 5, in one example embodiment, the connector 515 may include one or more conventional outlets. In this example, the connector 515 may facilitate the connection of the various conductors of the flat wire extension cord 502 (e.g., five conductors) to the conductors associated with the one or more conventional outlets.

A wide variety of different techniques and/or devices may be utilized as desired to store the flat wire extension cord 502 within the housing 505. In certain embodiments of the invention, a spooling mechanism, as described in greater detail below with reference to FIG. 6, may be contained within the housing 505. Portions of the flat wire extension cord 502 that are not extended from the housing 505 may be wrapped around or otherwise secured by the spooling mechanism within the housing 505. In this regard, the flat wire extension cord 502 may be stored in a manner that facilitates its easy extension from the housing 505 and retraction back into the housing 505.

With continued reference to FIG. 5, the extension cord system 500 may include one or more suitable devices and/or mechanisms that facilitate the locking of the flat wire extension cord 502 in place when it is extended a desired distance from the housing 505. These one or more suitable devices and/or mechanisms may aid in preventing the flat wire extension cord 502 from being extended further from the housing 505 and/or from being retracted into the housing 505. One example of a suitable device is a device that prevents a spooling mechanism from being rotated or otherwise manipulated in a manner that would facilitate the extension and/or retraction of the flat wire extension cord 502. Another example of a suitable device is a device that contacts the unwound portion of the flat wire extension cord 502 and facilitates holding the flat wire extension cord 502 in place. As shows in FIG. 5, a retention button 520 may be associated with the extension cord system 600. Selection and/or depression of the retention button 520 may actuate the one or more suitable devices and/or mechanisms that facilitates the prevention of the flat wire extension cord 502 from being extended and/or retracted. For example, selection of the retention button 520 may cause a tab or pin to contact the spooling mechanism in order to hold the spooling mechanism in place.

In operation, unless a retention device and/or mechanism is in use, the flat wire extension cord 502 may be extended from the housing 505 by applying a suitable force to the flat wire extension cord 502. For example, a user may pull the end of the flat wire extension cord 502 that extends through the slot 512 in order to extend the flat wire extension cord 502. In certain embodiments, the flat wire extension cord 502 may remain extended from the housing 505 unless it is rewound into the housing 505. A manual rewind device, such as a rewind handle 525, may be provided to facilitate rewinding of the flat wire extension cord 502. Additionally, in certain embodiments, a suitable recoil device, such as a spring-loaded recoil device, may be utilized to rewind the flat wire extension cord 502 unless a retention button 520 or other locking mechanism is in use. A recoil device may also facilitate rewinding of the flat wire extension cord 502 based upon the application of a suitable amount of tension to the flat wire extension cord 502 that activates the recoil device.

Extension cord systems in accordance with various embodiments of the invention, for example, extension cord system 500 illustrated in FIG. 5, may be portable extension cord systems. The housing 505 and the flat wire extension cord 502 may be transported by a user to a desired location prior to use. In this regard, the extension cord system 500 may be utilized in a wide variety of different environments, for example, in a garage, in a commercial establishment, in a residential building, and/or in an outdoor environment. The housing 505 may include one or more handles 530 that facilitate transportation of the extension cord system 500 to a desired location.

Figure 6:
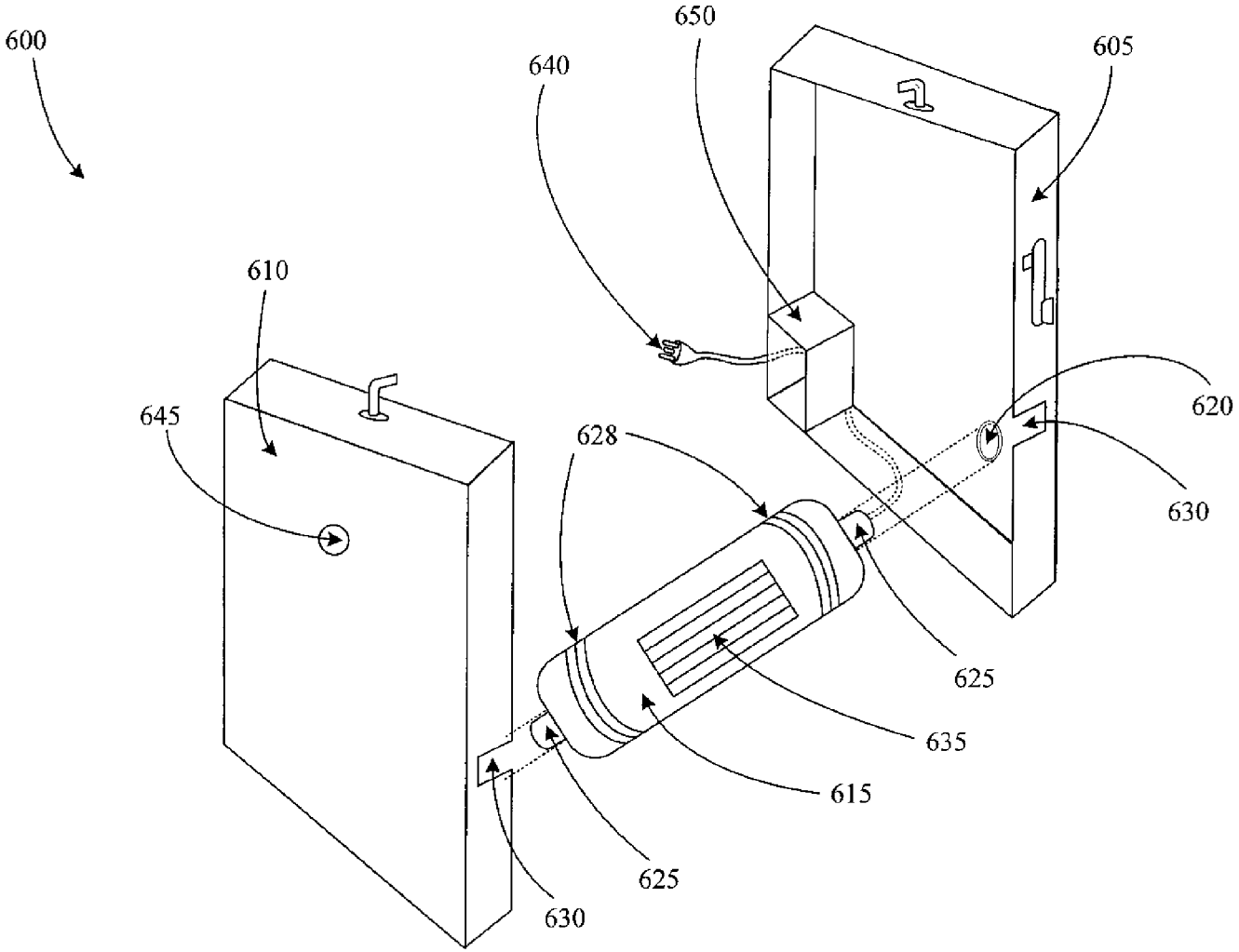
FIG. 6 is a partially exploded view of the extension cord system, in accordance with an illustrative embodiment of the invention.

FIG. 6 is a partially exploded view of an extension cord system 600, in accordance with an illustrative embodiment of the invention. The extension cord system 600 of FIG. 6 may include similar components to the extension cord system 500 illustrated in FIG. 5. The extension cord system 600 may include a housing that is constructed from one or more components and that facilitates the storage of a flat wire extension cord. As shown in FIG. 6, the housing may be formed from a first housing component 605 and a second housing component 610 that may be fixedly or removably attached to one another. Although the housing is illustrated as being formed from two components 605, 610, the housing may be formed from any number of components as desired in various embodiments of the invention. Furthermore, the components of the housing mar define both an exterior shell of the housing and an interior region of the housing in which a flat wire extension cord may be stored.

With continued reference to FIG. 6, a spooling mechanism 615 may be disposed within the housing of the extension cord system 600. The spooling mechanism 615 may facilitate winding up a flat wire extension cord, such as flat wire extension cord 502 shown in FIG. 5, within the housing. A wide variety of different types of spooling mechanisms 615 may be utilized as desired in various embodiments of the invention. As shown in FIG. 6, the spooling mechanism 615 may include a cylinder arrangement, and a flat wire extension cord may be wrapped or coiled around the cylinder arrangement as the cylinder arrangement is rotated. In other embodiments of the invention, the spooling mechanism 615 may include multiple cylinder arrangements and/or other arrangements that facilitate the storage of a flat wire extension cord.

The spooling mechanism 615 may be rotatably or pivotally mounted to the housing of the extension cord system 600. In an example embodiment, supports 620 for the spooling mechanism 615 may be integrated into or attached to the housing, and the spooling mechanism 615 and/or protrusions 625 extending from the ends of the spooling mechanism 615 may fit within the supports 620 in order to rotatably mount the spooling mechanism 615 to the housing. Additionally, in certain embodiments, one or more suitable bearings may be provided to assist with the rotation of the spooling mechanism 615.

One end of a flat wire extension cord, such as flat wire extension cord 502 shown in FIG. 5, may be attached to the spooling mechanism 615. As the spooling mechanism 615 is rotated in one direction, the flat afire extension cord may, be wrapped or wound around the spooling mechanism 615. The spooling mechanism 615 may include one or more spool guides 628 or protrusions that facilitate the winding of the flat wire extension cord and assist in preventing entanglements of the flat wire extension cord. As the spooling mechanism 615 is rotated in the opposite direction, the flat wire extension cord may be unwound from the spooling mechanism 615. As the flat wire extension cord is unwound, the flat wire extension cord may be extended from the housing via a slot 630.

Additionally, in certain embodiments of the invention, one or more feeding guides (not shown) may be provided to facilitate proper feeding of the flat wire extension cord as it is wound or unwound from the spooling mechanism 615. For example, one or more tabs may be extended from the housing, and the one or more tabs may facilitate the proper feeding of the flat wire extension cord as it is wound and/or unwound.

According to an aspect of the invention, the extension cord system 600 may include one or more suitable connectors that facilitate the connection of a line side input 640, such as a conventional wire and plug, to a flat wire extension cord. The one or more connectors may facilitate the termination of the conductors of the line side input 640 and the conductors of the flat wire extension cord. The one or more connectors may additionally facilitate the connection of one or more of the conductors of the line side input 640 to one or more of the conductors of the flat wire extension cord. Any number of connectors may be utilized as desired in various embodiments of the invention.

With reference to FIG. 6, a line side terminator 650 may be situated within the housing of the extension cord system 600. In certain embodiments, the line side terminator 650 may be situated within the housing but outside of the spooling mechanism 615. In other embodiments, the line side terminator 650 may be situated within the spooling mechanism 615. The conductors of the line side input 640 may be terminated at the line side terminator 650. For example, if the line side input 640 is a conventional wire, then the three conductors of the line side input 640 (e.g., hot, neutral, ground) may be terminated at the line side terminator 650. In certain embodiments, each of the conductors of the line side input (AO may, be terminated at a corresponding termination point of the line side terminator 650.

With continued reference to FIG. 6, a flat wire terminator 635 ma, be situated within the housing. The flat wire terminator 635 may, facilitate the termination of one or more of the conductors of the flat wire extension cord. For example, if the flat wire extension cord has a five conductor stacked arrangement as discussed above with reference to FIG. 3, then the flat wire terminator 635 may facilitate the termination of each of the five conductors. More specifically, the electrifiable conductor, two return conductors, and two grounding conductors may be terminated at the flat wire terminator 635. In certain embodiments, each of the conductors of the flat wire extension cord may be terminated at a corresponding termination point of the flat wire terminator 635.

In certain embodiments of the invention, the line side termination 650 and the flat wire termination 635 may be provided as part of a single connector between the line side input 640 and the flat wire extension cord. Any number of suitable connection techniques and/or devices may be utilized within the connector to facilitate the connection of the conductors of the line side input 640 to the conductors of the flat wire extension cord. Utilizing the example of a conventional line side input and a five conductor flat wire extension cord, the termination points associated with the three conductors of the line side input 640 may, be connected to the termination points associated with the five conductors of the flat wire extension cord. For example, the termination point for the electrifiable conductor of the line side input 640 may be connected to the termination point for the electrifiable conductor of the flat wire extension cord, the termination point for the return or neutral conductor of the line side input 640 may be connected to the termination points for the return or neutral conductors of the flat wire extension cord, and the termination point for the ground conductor of the line side input 640 may be connected to the termination points for the ground conductors of the flat wire extension cord. In certain embodiments, suitable wiring and/or other conductors situated within the housing may be utilized to connect the termination points of the line side terminator 650 with respective termination points of the flat wire terminator 635. The wiring and/or other conductors may extend from the line side terminator 650 to the flat wire terminator 635. In one example embodiment, the wiring and/or other conductors may be extended into the spooling mechanism 615 at one end of the spooling mechanism 615 and may be connected to the flat wire terminator 635 from within the spooling mechanism. Any number of suitable mechanisms, devices, and/or techniques may be utilized to facilitate connection of the wiring and/or conductors extending into the spooling mechanism 615 to the flat wire terminator 635 while allowing the spooling mechanism 615 to be freely rotated. Examples of devices that facilitate the free rotation of the spooling mechanism 615 when wiring and/or conductors are extended into the spooling mechanism 615 include, but are not limited to, wiper mechanisms, three-ring donuts, slip-rings and/or other devices that facilitate rotatable interconnects of wiring. Additionally, in certain embodiments, the flat wire terminator 635 may be incorporated into or affixed to the spooling mechanism 615. In this regard, the rotation of the spooling mechanism 615 may be facilitated by the placement or positioning of the wiring and/or other conductors that are utilized in the connector.

In certain embodiments of the invention, various safety devices may be incorporated into or integrated into the extension cord system 600. Example safety devices include, but are not limited to, ground fault circuit interrupters (GFCI's), arc fault circuit interrupters (AFCI's), arc detection circuitry, and/or active safety devices (ASD's). An active safety device (ASD) may be configured to monitor a flat wire extension cord and/or any downstream devices or loads prior to, during, and/or subsequent to the electrification of the flat wire extension cord.

The extension cord system 600 illustrated in FIG. 6 may include similar components to the extension cord system 500 illustrated in FIG. 5. However, the extension cord system 600 as shown in FIG. 6 may include an automatic recoil mechanism or device. A wide variety of suitable devices and/or techniques, for example, an appropriate spring loaded device attached to the spooling mechanism 615, may be utilized as a recoil mechanism. Following the extension of at least a portion of the flat wire extension cord from the housing of the extension cord system 600, the actuation of a recoil button 645 or recoil tab may actuate the recoil mechanism and automatically rewind the flat wire extension cord.

Figure 7:
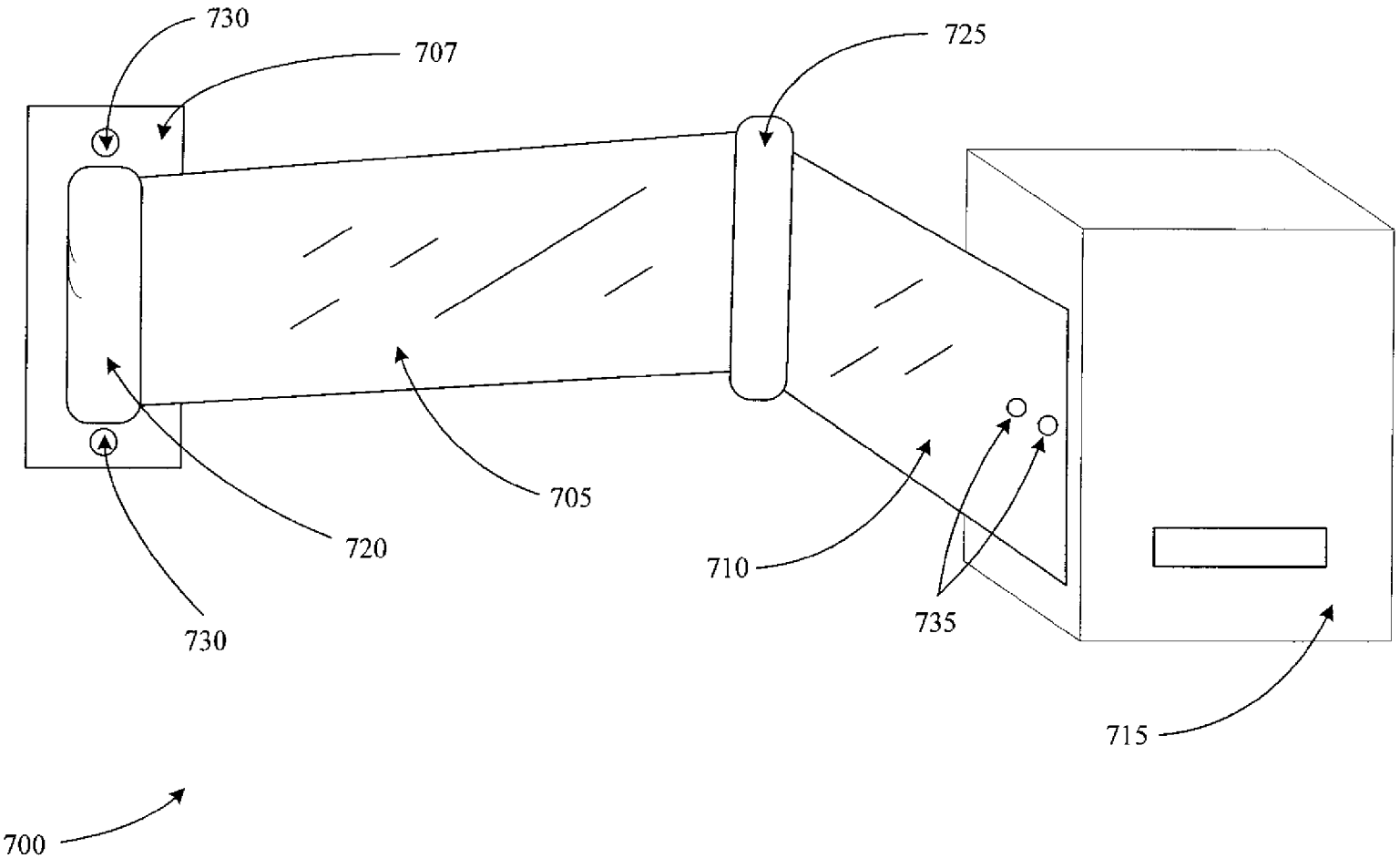
FIG. 7 is a perspective view of another example extension cord system in accordance with an illustrative embodiment of the invention.

FIG. 7 is a perspective view of another example extension cord system 700 in accordance with an illustrative embodiment of the invention. The extension cord system 700 illustrated in FIG. 7 shows one example of a bracket that may be utilized to mount a flat wire extension cord and its associated housing 715. A wide variety of different types of brackets, combinations of brackets, and/or other mounting devices may be utilized as desired in various embodiments of the invention. One example bracket may include a first extension arm 705 that may be pivotally or rotatably connected on one end to a plate 707 that may be mounted to a surface, such as a wall or desk. The distal end of the first extension arm 705 may be pivotally or rotatably connected to a second extension arm 710. The housing 715 for a flat wire extension cord may be connected to the end of the second extension arm 710 that is not connected to the first extension arm 705.

Various types of connection devices may be utilized as desired to facilitate connections within the extension cord system 700. For example, a first hinge 720 may facilitate the connection of the first extension arm 705 to the plate 707, and a second hinge 725 may facilitate the connection of the first extension arm 705 to the second extension arm 710. Suitable mounting devices, such as screws or bolts may facilitate the connection of the plat 707 to a surface and/or the connection of the housing 715 to the second extension arm 710. The first extension arm 705 may, be extended from the plate 707 at any angle (e.g., an angle between approximately zero degrees and approximately 180 degrees) in a plane that is perpendicular to the surface. The second extension arm 710 may then be extended from the first extension arm 705 at virtually any angle within the same plane (e.g., an angle between approximately zero degrees and approximately 360 degrees relative to the first extension arm). In this regard, the bracket may be extended from the surface at virtually any angle within the plane to facilitate the accessibility of the flat wire extension cord. The bracket may then be folded up against the surface when the flat wire extension cord is not in use.

Although the bracket of FIG. 7 is illustrated with two extension arms 705, 710 that facilitate extension of the bracket at a wide variety of angles within the same plane, in other embodiments of the invention, any number of brackets and/or connections between the brackets may be utilized to facilitate the extension of the brackets and/or housing from a surface at any angle and within any plane relative to the surface. The bracket illustrated in FIG. 7 is provided by way of a simplified example only.

Figure 8:
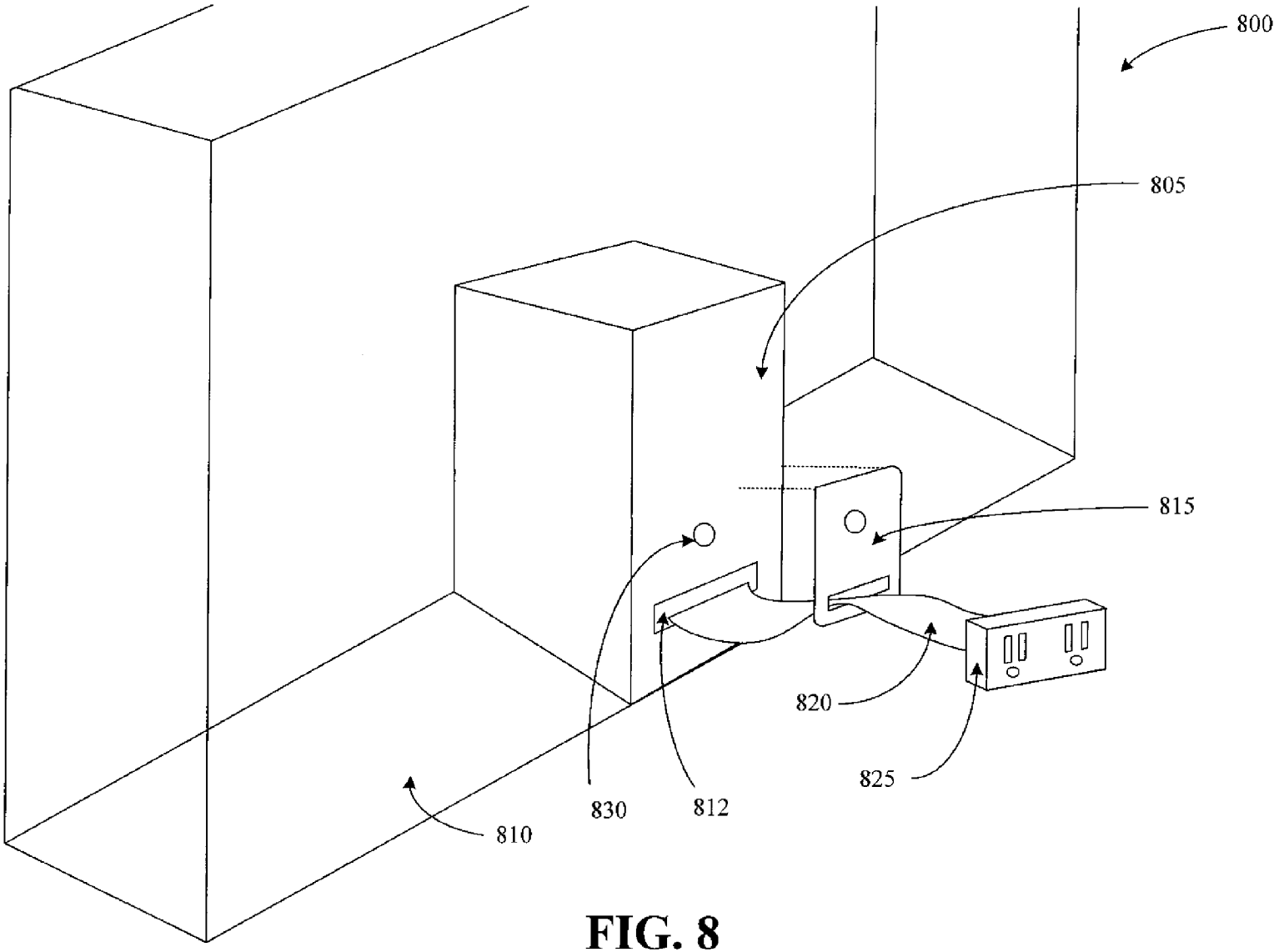
FIG. 8 is a perspective view of yet another example extension cord system in accordance with an illustrative embodiment of the invention.

FIG. 8 is a perspective view of yet another example extension cord system 800 in accordance with an illustrative embodiment of the invention. The extension cord system 800 shown in FIG. 8 shows one example of the mounting of a flat wire extension cord housing 805 within a wall 810 such that a flat wire extension cord 820 associated with the housing 805 may be extended from the wall 810. As shown in FIG. 8, the housing 805 may be situated or mounted within a wall 810. The housing 805 may rest on the floor or alternatively, the housing 805 may be connected to a stud or other component of the wall 810.

An opening, such as a hole, may be created within the wall that aligns with the slot 812 of the housing 805 through which the flat wire extension cord 820 is extended. In certain embodiments, a face plate 815 may be provided to cover the opening in the wall 810. The face plate 815 may include an opening or slot that aligns with the slot 812 of the housing 805. The flat wire extension cord 820 may extend from the housing 805 through the openings in the wall 805 and the face plate 815 and may provide power to a load 825 connected to a distal end of the flat wire extension cord 820.

Additionally, in certain embodiments of the invention that include a recoil mechanism, an activation button or tab 830 that facilitates the activation of the recoil mechanism ma), be provided on the surface of the housing 805 that aligns with the face plate 815. Corresponding openings may be provided in the wall 810 and the face plate 815 to facilitate activation of the button 830 by a user.

According to an aspect of the invention, embodiments of the flat wire extension cord, such as flat wire extension cord 300 shown in FIG. 3, may itself be designed to be safe if it is penetrated. Fire protection and electric shock safety are based on limiting the voltage, and therefore the current in the flat wire extension cord 300 while expediting the trip time of a primary safety device such as a circuit breaker or a fuse in a branch circuit main box. Secondary protection may also be provided by an ASD.

The flat wire extension cord 300 may, be designed to produce a short between a first grounding conductor 320, a first return conductor 310, an electrifiable conductor 305, a second return conductor 315, and a second grounding conductor 325 (G-N-H-N-G) in that sequence upon penetration. With as much as about four times the conductance ultimately tied to earth ground, a voltage divider is formed favoring the ground voltage over the line or hot voltage. Repeated tests show that voltages present at the site of penetrations of the flat wire extension cord 300 do not exceed approximately 50 VAC for longer than a primary safety device's trip time, which is typically under about 25 milliseconds. Furthermore, the voltage present at the site of penetrations does not exceed approximately 50 VAC for longer than the trip time of a secondary safety device such as an ASD, which may be approximately 8 milliseconds.

Penetration may occur through the broadside or the flat surface of a flat wire extension cord 300 by sharp objects. Alternatively, penetration may occur through an edge of the flat wire extension cord 300 by an object such as a knife blade or drywall saw. In either situation, the resulting short may cause a high current to be produced at a low voltage for a short time (less than the trip time). Startle effect, or sound burst, and localized heating may be minimized due to the nature of the protective layered flat wire extension cord 300.

FIGS. 9A-F are a series of diagrams which depict an example of the dynamics of a nail or tack penetration of a live multi-planar fat wire extension cord 300. Again, a protective layered flat wire extension cord 300 has a distinct advantage over conventional wire and extension cords by assuring that a penetrating object 900, for example, a nail, first passes through a grounding conductor (G1) 320, then a return or neutral conductor (N1) 310 prior to any contact with the hot electrifiable conductor 305.

Figure 9A:
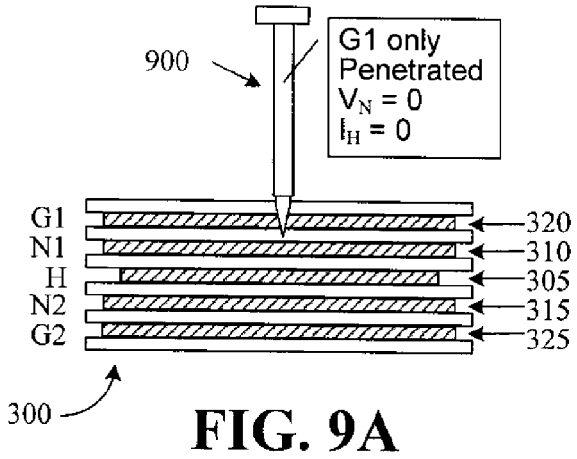
FIGS. 9A-9F are cross-section views depicting an example of the dynamics of a nail or tack penetration of a live extension cord in accordance with an illustrative embodiment of the invention.
Figure 9B:
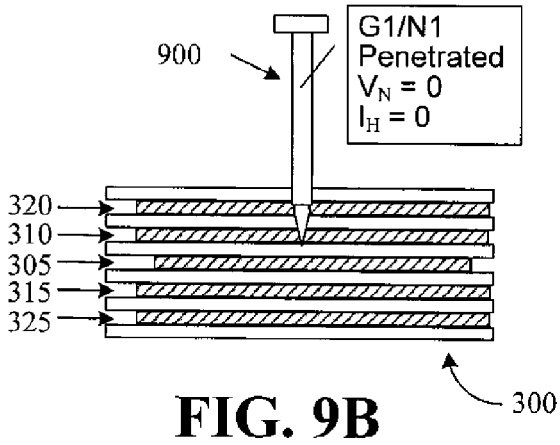

FIG. 9A depicts a situation in which a penetrating object 900 has only penetrated one grounding conductor 320 of the flat wire extension cord 300. Similarly, FIG. 9B depicts a situation in which a penetrating object 900 has penetrated only one grounding conductor 320 and one return conductor 310. In both FIGS. 9A and 9B, the electrifiable conductor 305 has not yet been penetrated. Accordingly, in both FIGS. 9A and 9B, there may be no voltage or current present on the penetrating object 900. Additionally, the current present on the electrifiable conductor 305 of the flat wire extension cord 300 may be some normal load current. The normal load current present on the electrifiable conductor 305 may be a current which is less than approximately 15 amps in a standard United States branch application or which is less than approximately 6 amps in a standard European branch application.

Figure 9C:
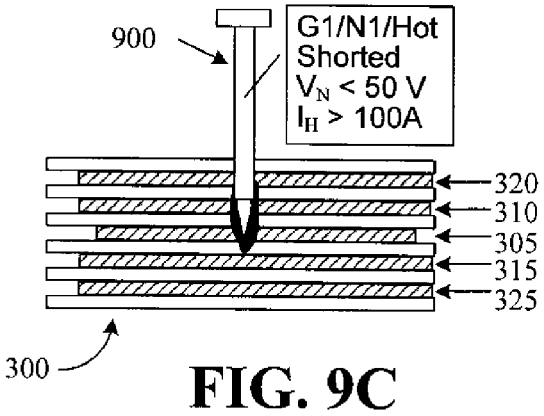
Figure 9D:
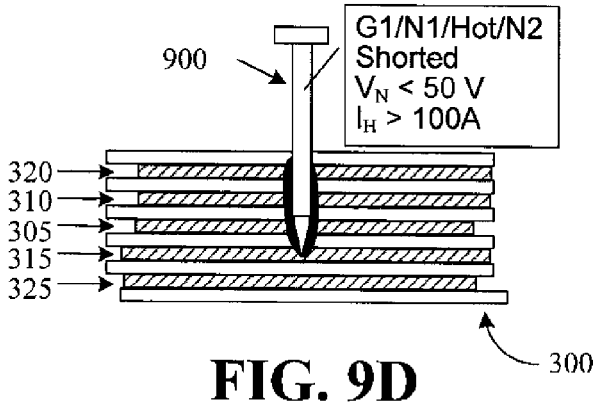
Figure 9E:
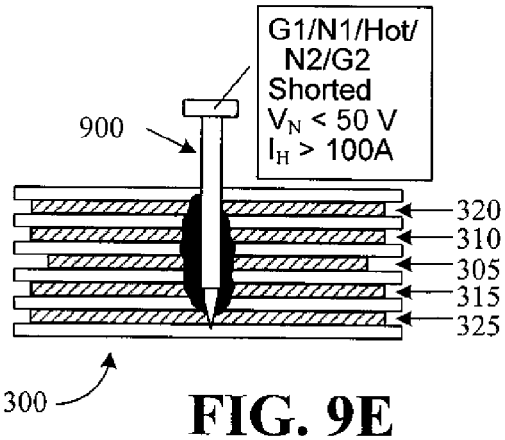

FIG. 9C depicts a situation in which the penetrating object 900 has shorted the electrifiable conductor 305, one of the return conductors 310 and one of the grounding conductors 320. Similarly, FIG. 9D depicts a situation in which the penetrating object 900 has shorted the electrifiable conductor 305, both of the return conductors 310, 315 and one of the grounding conductors 320. FIG. 9E depicts a situation in which the penetrating object 900 has shorted the electrifiable conductor 305, both of the return conductors 310, 315 and both of the grounding conductors 320, 325. In each of FIGS. 9C-9E, the short circuit created in the flat wire extension cord 300 between the electrifiable conductor 305 and any of the other conductors 310, 315, 320, 325 may act as a voltage divider until a primary safety device such as a circuit breaker or a secondary safety device such as an ASD trips. In each of FIGS. 9C-9E, there may be a relatively low voltage present on the penetrating object 900. The low voltage may be less than approximately 50 VAC on a standard 120 VAC wire, and the low voltage may be less than approximately 100 VAC on a standard 240 VAC line. Additionally in each of FIGS. 9C-9E, the current present on the electrifiable conductor 305 may exceed approximately 100 amps until the primary or secondary safety device (ASD) trips. There also may be a current present on either of the grounding conductors 320, 325 and/or on either of the return conductors 310, 315 which will also facilitate the tripping of the ASD.

The time for penetrating from an outer grounding layer 320 to an electrifiable conductor 305 (FIGS. 9A-9C) may typically be under one millisecond, which is only a fraction of a typical trip time for a primary safety device such as a circuit breaker. Similarly, the time to continue penetration from an electrifiable conductor 905 to the backside grounding layer 925 (FIGS. 9C-9E) may, also be relatively short. The short circuit created during the penetration may be of a continuous nature. The continuous nature of the short circuit may be due to two primary factors: firstly, the conductor contact at the sides of the penetrating object 900 is maintained by the insulation displacement process during penetration and secondly, by the molten copper in the proximity of the contact area once the short begins.

Figure 9F:
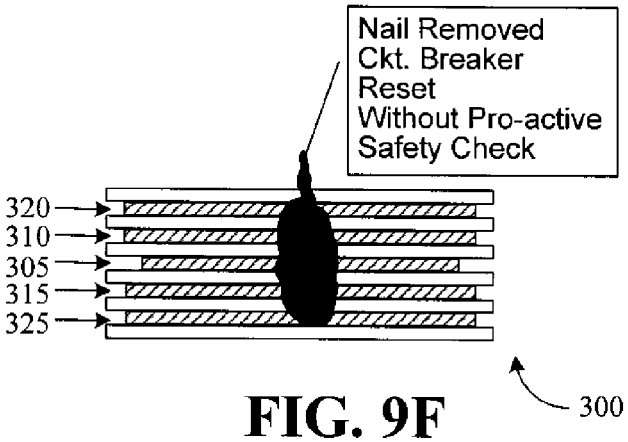

FIG. 9F depicts a penetration after a penetrating object 900 has been removed from the flat wire extension cord 300. If the circuit breaker has been reset prior to the flat wire extension cord 300 being electrified, then some additional damage may be done to the flat wire extension cord 300 before the circuit breaker trips again; however, if an ASD is connected to the flat wire extension cord 300, then any additional damage may be prevented. The proactive safety components of the ASD may determine that a fault exists on the flat wire extension cord 300 prior to allowing the flat wire extension cord 300 to be fully electrified. For example, when testing the flat wire extension cord 300 prior to electrification, the ASD 100 may determine that a short exists between the conductors or layers of the flat wire extension cord 300. The ASD will then prevent the flat wire extension cord 300 from being electrified.

Figure 10A:
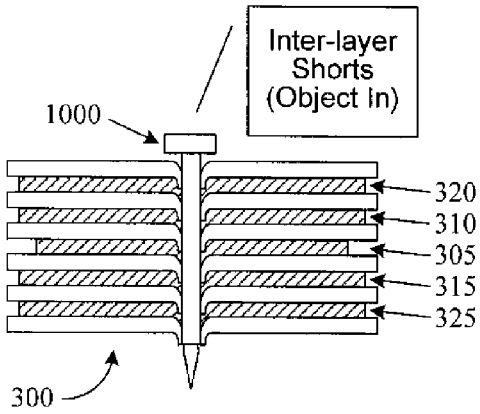
FIGS. 10A-10D are cross-section views depicting examples of the dynamics of a penetration of a non-live extension cord in accordance with an illustrative embodiment of the invention.
Figure 10B:
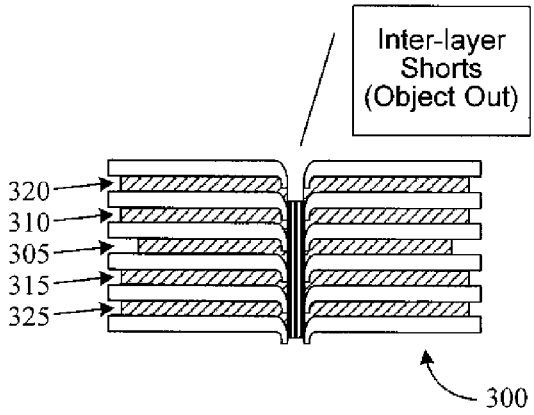

FIGS. 10A-10D are a series of diagrams which depict examples of the dynamics of a penetration of a non-live multi-planar flat wire extension cord 300. FIG. 10A shows the inter-layer shorts that occur when a penetrating object 1000, such as a nail, penetrates the flat wire extension cord 300. Without electrification, the conductors of the flat wire extension cord 300 may not experience additional damage or fusion from high currents; however, multiple inter-layer shorts may be caused. FIG. 10B shows the residual inter-layer shorts after the penetrating object 1000 has been removed from the flat wire extension cord 300. An ASD 100 connected to the flat wire extension cord 300 may be able to detect this inter-layer short prior to allowing the flat wire extension cord 300 to be fully electrified. The ASD may also be able to determine that one or more layer loops of the flat wire extension cord 300, such as a grounding layer loop or a return conductor layer loop, are incomplete prior to allowing the flat wire extension cord 300 to be fully electrified. The proactive safety components of the ASD may prevent flashes or plumes (e.g., arc flashes) which may occur upon electrification of the flat wire extension cord 300 by recognizing defects prior to allowing the flat wire extension cord 300 to be fully electrified.

If the penetrating object 1000 penetrated the flat wire extension cord 300 after the flat wire extension cord 300 had been electrified, then reactive safety components, such as a GFCI or reactive components associated with an ASD, may detect the flaw in the flat wire extension cord 300 and de-energizing the flat wire extension cord 300.

Figure 10C:
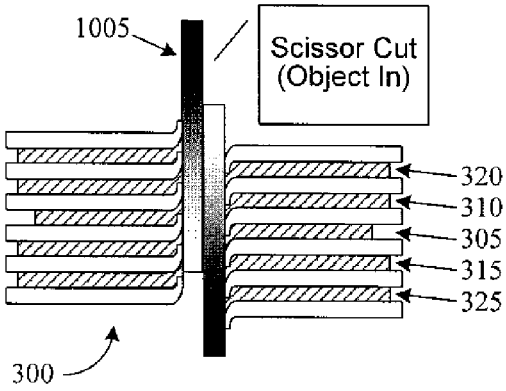
Figure 10D:
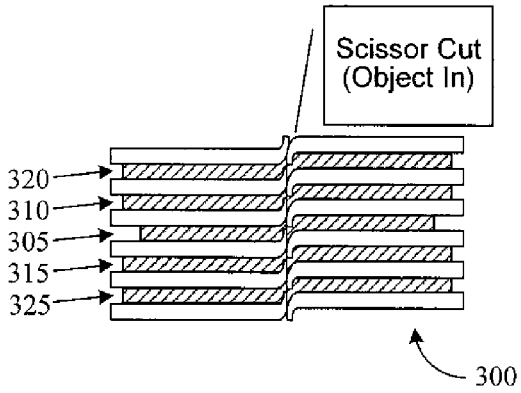

FIG. 10C depicts the transverse cut of a flat wire extension cord 300 by a cutting object 1005, such as a pair of scissors. In FIG. 10C, the cutting object 1005 is shown still in the flat wire extension cord 300 during the cut FIG. 10D depicts how a partially cut flat wire extension cord 300 section would appear once the cutting object 1005 has been removed. An ASD connected to the flat wire extension cord 300 may be able to detect the inter-layer shorts created by the cutting object 1005 prior to allowing the flat wire extension cord 300 to be fully electrified. Alternatively, the ASD may be able to determine that the layer loops of the flat wire extension cord 300, such as the grounding layer loop or the return conductor latter loop, are incomplete prior to allowing the flat wire extension cord 300 to be fully electrified. The proactive safety components of an ASD may prevent flashes or plumes (e.g., arc flashes) which may occur on the flat wire extension cord 300 by recognizing defects prior to allowing the flat wire extension cord 300 to be fully electrified.

If the cutting object 1005 cuts the flat wire extension cord 300 after the flat wire extension cord 300 has been electrified, then reactive safety components connected to the flat wire extension cord 300, such as a GFCI or reactive safety components of an ASD, may detect the flaw in the flat wire extension cord 300 and de-energize the flat wire extension cord 300.

Figure 11:
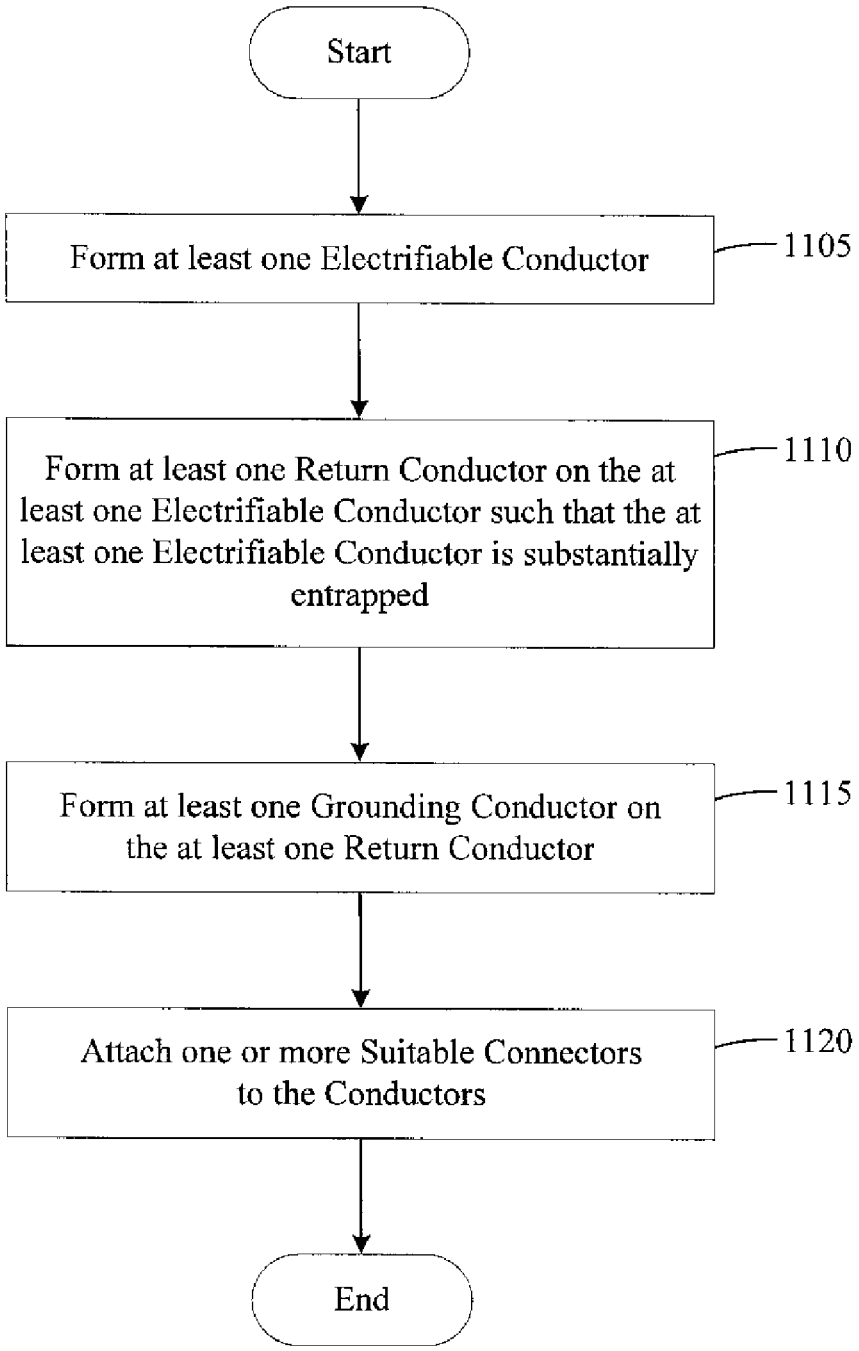
FIG. 11 is a flowchart of one example method for forming a flat wire extension cord in accordance with an illustrative embodiment of the invention.

FIG. 11 is a flowchart of one example method 100 for forming or fabricating a flat wire extension cord, such as flat wire extension cord 300 illustrated in FIG. 3, in accordance with an illustrative embodiment of the invention. The method may begin at block 1105. At block 1105, at least one electrifiable conductor may be formed. At block 1110, at least one return conductor may be formed on the at least one electrifiable conductor such that the at least one electrifiable conductor is substantially entrapped by the at least one return conductor. In certain embodiments, a pair of return conductors may be formed on opposing sides of the at least one electrifiable conductor. In other embodiments, a return conductor may be formed around the electrifiable conductor such that the electrifiable conductor is completely entrapped by the return conductor.

At block 1115, which may be optional in various embodiments of the invention, at least one grounding conductor may be formed on the at least one return conductor. In certain embodiments, a pair of grounding conductors may be formed on opposing sides of the at least one return conductor. In other embodiments, a grounding conductor may be formed around the at least one return conductor such that the at least one return conductor is completely entrapped by the grounding conductor.

At block 1120, the conductors of the flat wire extension cord 300 may be connected or attached to one or more suitable connection devices. These connection devices may facilitate connection of the flat wire extension cord 300 to a line side input and/or to a load. The method may end following block 1120.

The conductors of the flat wire extension cord 300 (e.g., the electrifiable, return and grounding conductors) may be formed of a substantially conductive medium, and may include, for example, copper, aluminum, steel, silver, gold, platinum, nickel, tin, graphite, silicon, an alloy including any of these, conductive gas, metal, alloy metal. That is, the conductors may include any material that is able to transfer electrons regardless of efficiency in doing so. This is true as long as the relative ability to transfer electrons in the "conductors" is substantially better than the "insulators".

Additionally, when forming a flat wire extension cord 300, one or more insulating layers may be formed between the one or more conductors of the flat wire extension cord 300. The insulating layers of the flat wire extension cord 300 math be formed of substantially non-conductive mediums ("insulators"), and may, include, for example, a material that is organic, inorganic, composite, metallic, carbonic, homogeneous, heterogeneous, thermoplastic (e.g. poly-olefin, polyester, polypropylene, polyvinyl chloride (PVC)), thermoset, wood, paper, anodic formation, corrosive layer, or other.

The insulating layers can be made of any material that is ratiometrically less (e.g., proportionally less) able to conduct electricity than the conductors. A distinguishing feature of the insulating layers (which determines the implied ratio), is that their size, shape, and dielectric strength are independent variables whose resulting dependant variable is the maximum design voltage, between the aforementioned "conductors", before substantial current flows through the insulating medium due to a break-down of its insulating properties.

The substantial current typically creates a condition that could result in catastrophic failure of the flat wire extension cord 300. The insulating layers should be designed such that in the typical application or intended use of the flat wire extension cord 300, there is no break-down between the conductors (e.g., substantially conductive mediums), through the insulating layers (e.g., substantially non-conductive mediums).

The flat wire extension cord 300 may be formed by layering (e.g., laminating) the conductors and insulating layers (e.g., substantially conductive and substantially non-conductive mediums (e.g., laminates). Further, laminates including pre-manufactured materials facilitate bulk rolling.

Most conventional electrical wires and extension cords are made by wrapping flat insulators around the axis of a round wire bundle in the form of a helix. Also most individual wires are insulated by having a plastic PVC sheath extruded around the round wire.

The flat wire extension cord 300 according to the example embodiments of the invention, however, may include a rolled sheet or foil that is slit to the desired widths. The same is true of the insulating material. Those conductors and insulators which are processed by rolling techniques may then be coated with adhesives that allow the dissimilar materials to be bonded to one another in a continuous feed process. The slitting may occur before the bonding of the dissimilar materials or after, depending on the geometric configuration. For example, in one embodiment of the invention, the insulators and conductors are slit before bonding materials together.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed is:

1. An extension cord, comprising:

an elongated cord comprising:

at least one electrifiable conductor for delivering electrical power;

first and second insulating layers formed on opposing sides of the at least one electrifiable conductor;

first and second return conductors formed on the first and second insulating layers, respectively, such that said at least one electrifiable conductor is at least substantially entrapped by said first and second return conductors;

a first connector attached to a first end of the elongated cord and operable to connect the conductors of the elongated cord to a line side input; and a second connector attached to a second end of the elongated cord opposite the first end, the second connector operable to connect the conductors of the elongated cord to a load.

2. The extension cord according to claim 1, wherein the elongated cord further comprises:

third and fourth insulating layers formed on said first and second return conductors, respectively; and first and second grounding conductors formed on said third and fourth insulating layers, respectively.

3. The extension cord according to claim 2, wherein an object penetrating an outer surface of the elongated cord contacts at least one of the first and second grounding conductors and at least one of the first and second return conductors before contacting the at least one electrifiable conductor.

4. The extension cord according to claim 1, wherein a total thickness of the elongated cord is no more than approximately 0.050 inches.

5. The extension cord according to claim 1, wherein a distance between said at least one electrifiable conductor and each of said first and second return conductors is no greater than approximately 0.030 inches.

6. The extension cord according to claim 1, wherein the elongated cord comprises one of an approximately 120V AC elongated cord or an approximately 240V AC elongated cord.

7. The extension cord according to claim 1, wherein said elongated cord comprises a flexible elongated cord.

8. The extension cord according to claim 1, wherein each of said at least one electrifiable conductors comprises a thickness which is in a range from about 0.0004 inches to about 0.020 inches.

9. The extension cord according to claim 1, wherein the line side input comprises a conventional three-conductor electrical line side input, and wherein the first connector is operable to connect one or more conductors of the line side to one or more corresponding conductors of the elongated cord.

10. The extension cord according to claim 1, wherein the load comprises a conventional electrical outlet, and wherein the second connector is operable to connect one or more conductors of the elongated cord to one or more corresponding conductors of the conventional electrical outlet.

11. An extension cord system, comprising:

an extension cord comprising:

at least one electrifiable conductor for delivering electrical power;

first and second insulating layers formed on opposing sides of the at least one electrifiable conductor; and first and second return conductors formed on the first and second insulating layers, respectively, such that said at least one electrifiable conductor is at least substantially entrapped by said first and second return conductors; and a housing, comprising:

one or more components that define an interior portion in which at least a portion of the extension cord is housed, wherein an opening is defined in the one or more components through which an un-housed portion of the extension cord is extended;

a spooling mechanism operable to wind up the at least a portion of the extension cord that is housed within the housing; and a connector operable to connect the conductors of the extension cord to a line side input.

12. The extension cord system according to claim 11, wherein the extension cord further comprises:

third and fourth insulating layers formed on said first and second return conductors, respectively; and first and second grounding conductors formed on said third and fourth insulating layers, respectively.

13. The extension cord system according to claim 12, wherein an object penetrating an outer surface of the extension cord contacts at least one of the first and second grounding conductors and at least one of the first and second return conductors before contacting the at least one electrifiable conductor.

14. The extension cord system according to claim 11, wherein a total thickness of the extension cord is no more than approximately 0.050 inches.

15. The extension cord system according to claim 11, wherein a distance between said at least one electrifiable conductor and each of said first and second return conductors is no greater than approximately 0.030 inches.

16. The extension cord system according to claim 11, wherein the extension cord comprises one of an approximately 120V AC extension cord or an approximately 240V AC extension cord.

17. The extension cord system according to claim 11, wherein said extension cord comprises a flexible extension cord.

18. The extension cord system according to claim 11, wherein each of said at least one electrifiable conductors comprises a thickness which is in a range from about 0.0004 inches to about 0.020 inches.

19. The extension cord system according to claim 11, wherein the line side input comprises a conventional three-conductor electrical line side input, and wherein the connector is operable to connect one or more conductors of the line side to one or more corresponding conductors of the extension cord.

20. The extension cord system according to claim 11, wherein the connector is a first connector, and further comprising:

a second connector attached to an end of the extension cord that is extendible from the housing and operable to connect one or more of the conductors of the extension cord to a load.

21. The extension cord system according to claim 20, wherein the load is a conventional electrical outlet, and wherein the second connector is operable to connect one or more conductors of the extension cord to one or more corresponding conductors of the conventional electrical outlet.

22. The extension cord system according to claim 11, further comprising:

a refraction device operable to facilitate winding up the extension cord.

23. The extension cord system according to claim 11, wherein the housing comprises a portable housing.

24. The extension cord system according to claim 11, further comprising:

a bracket operable to rotatably mount the housing to a surface.

* * * * *